US011729891B2

(12) United States Patent
Jo

(10) Patent No.: US 11,729,891 B2
(45) **Date of Patent: *Aug. 15, 2023**

(54) METHOD AND DEVICE FOR CONTROLLING A PLURALITY OF WIRELESS LIGHTING DEVICES

(71) Applicant: Beatro Co., Ltd., Seoul (KR)

(72) Inventor: Sang Min Jo, Seoul (KR)

(73) Assignee: Beatro Co., Ltd., Seoul (KR)

( * ) Notice: Subject to any disclaimer, the term of this patent is extended or adjusted under 35 U.S.C. 154(b) by 107 days.

This patent is subject to a terminal disclaimer.

(21) Appl. No.: 17/367,702

(22) Filed: Jul. 6, 2021

(65) Prior Publication Data

US 2022/0015214 A1 Jan. 13, 2022

Related U.S. Application Data

(63) Continuation of application No. 16/855,596, filed on Apr. 22, 2020, now Pat. No. 11,096,263, which is a (Continued)

(30) Foreign Application Priority Data

Apr. 22, 2019 (KR) ..... 10-2019-0046905
Apr. 22, 2019 (KR) ..... 10-2019-0046906

(51) Int. Cl.
*H05B 47/19* (2020.01)
*H05B 47/155* (2020.01)

(52) U.S. Cl.
CPC ..... *H05B 47/19* (2020.01); *H05B 47/155* (2020.01)

(58) Field of Classification Search
CPC .... H05B 47/175; H05B 47/18; H05B 47/185; H05B 47/19
See application file for complete search history.

(56) References Cited

U.S. PATENT DOCUMENTS

2013/0285574 A1* 10/2013 Garcia Morchon ..... H04L 12/2803 315/297
2015/0373813 A1* 12/2015 Nieuwlands ..... H05B 47/175 315/294

(Continued)

FOREIGN PATENT DOCUMENTS

JP 2017-157549 A 9/2017
JP 2017-195124 A 10/2017

*Primary Examiner* — Renan Luque
(74) *Attorney, Agent, or Firm* — Edwin A. Sisson, Attorney at Law, LLC; Jeffrey J. Banyas; John W. Bain

(57) ABSTRACT

Disclosed is a method for controlling a plurality of wireless lighting devices. In an example embodiment of the present disclosure, the method includes the steps of: acquiring coordinate information having the plurality of wireless lighting devices mapped to coordinate values of a coordinate system; generating lighting control information indicating a response of at least one of the plurality of wireless lighting devices to produce a lighting shape of the coordinate system; and transmitting the lighting control information, wherein the lighting control information includes response information and function information, the response information indicates a lighting response of the wireless lighting device, and the function information indicates a response or non-response of the at least one wireless lighting device based on the coordinate values.

14 Claims, 38 Drawing Sheets

Related U.S. Application Data continuation of application No. PCT/KR2019/005717, filed on May 13, 2019.

(56) References Cited

U.S. PATENT DOCUMENTS

2018/0288851 A1* 10/2018 Rozendaal ..... H05B 47/155
2019/0289692 A1* 9/2019 Morita ..... H05B 45/20

* cited by examiner

| Code information | | Device ID information | Coordinate information | | | Time information | Additional information |
|---|---|---|---|---|---|---|---|
| COMPANY CODE | ARTIST CODE | UID | x | y | z | t | etc. |

| Code information | | Response information | Index information | Function information | Function parameter information | index information | Region parameter information |
|---|---|---|---|---|---|---|---|
| A | 1 | (255, 0, 0, 0) | 1 | - | a=0, b=0 | 5 (≤) | d=10 |

(a)

(b)

(a) Response information = (0,255,0,0)

(b) Response information = (0,0,255,0)

(c) Response information = (255,255,0,0)

(d) Response information = (0,255,255,0)

(a) a=-5, b=5

(b) a=5, b=5

(a) a=-5, b=5

(d) a=5, b=-5

| | | |
|---|---|---|
| 2 | ≠ | not equal |

| | | |
|---|---|---|
| 3 | < | smaller |

| | | |
|---|---|---|
| 5 | ≦ | smaller or equal |

| | | |
|---|---|---|
| 6 | ≧ | larger or equal |

| | | |
|---|---|---|
| 7 | ≦ | smaller or not equal |

| | | |
|---|---|---|
| 7 | ≦ | smaller or not equal |

(a) d=2

(b) d=6

(c) d=14

(d) d=20

| BL-CODE | | Response information | Function index information | Text function information | Function parameter information | Region index information | Region parameter information |
|---|---|---|---|---|---|---|---|
| A | 1 | (255, 0, 0, 0) | 2 | - | a=0, b=0<br>m=6, n=4 | 5 (≤) | d=1 |

(a)

(b)

| BL-CODE | | Response information | Index information | Function information | Function parameter information | Index information | Region parameter information |
|---|---|---|---|---|---|---|---|
| A | 1 | (255, 0, 0, 0) | 3 | - | a=0, b=0<br>m=1, n=0 | 1 (=) | - |

(a)

(b)

| BL-CODE | | Response information | Function index information | Text function information | Function parameter information | Region index information | Region parameter information |
|---|---|---|---|---|---|---|---|
| A | 1 | (255, 0, 0, 0) | 4 | - | a=5 | 1 (=) | - |

(a)

(b)

| BL-CODE | | Response information | Function index information | Text function information | Function parameter information | Region index information | Region parameter information |
|---|---|---|---|---|---|---|---|
| A | 1 | (255, 0, 0, 0) | 255 | \|y\|=x | a=5 | 1 (=) | - |

(a)

(b)

| BL-CODE | | Response information | Function index information | Text function information | Function parameter information | Region index information | Region parameter information |
|---|---|---|---|---|---|---|---|
| A | 1 | (255, 0, 0, 0) | 254 | - | a=8, b=5, c=1 | 1 (=) | - |

(a)

(b)

| BL-CODE | | Response information | Function index information | Text function information | Function parameter information | Region index information | Region parameter information |
|---|---|---|---|---|---|---|---|
| A | 1 | (255, 0, 0, 0) | 101 | z=a | 1 | 1 (=) | - |

(a)

(b)

| BL-CODE | | Response information | Function index information | Text function information | Function parameter information | Region index information | Region parameter information |
|---|---|---|---|---|---|---|---|
| A | 1 | (255, 0, 0, 0) | 0 | - | - | - | - |

(a)

(b)

METHOD AND DEVICE FOR CONTROLLING A PLURALITY OF WIRELESS LIGHTING DEVICES

TECHNICAL FIELD

The present disclosure relates to a method and device for controlling a plurality of wireless lighting devices, and particularly, to a method and device for providing a variety of producing effects by controlling a lighting response, such as a lighting color of each of the plurality of wireless lighting devices.

BACKGROUND ART

Along with advanced communication technology and semiconductor technology, communication equipment has become extremely miniaturized. In addition, introduction of Internet of Things (IoT) technology has enabled communications for many home appliances or portable devices.

Existing performance producing or directing effects for a performance venue have been mostly implemented by providing lighting and acoustic effects in the performance venue. Spectators who entered the venue may hold up their own lighting devices, such as mobile phones or light sticks, for cheering. Lighting/emitting devices, including LCDs, LEDs or other lighting devices, provide a lighting effect. The lighting device may emit light in a wide variety of colors. Nowadays, since lighting devices having communication equipment added thereto are being prevalently used, performance production using wireless lighting devices possessed by individual spectators has been made possible.

DESCRIPTION OF INVENTION

Technical Problem

Producing a stage performance can be achieved by wirelessly controlling wireless lighting devices possessed by individual spectators. A transmitting device needs to transmit control signals to corresponding lighting devices, and the corresponding lighting devices operate based on the control signals. However, in order to individually control a plurality of lighting devices, a plurality of commands or signals should be transmitted, which may result in an operation lag/delay. The operation lag/delay in producing a performance may cause a huge impediment to the performance.

Solution to Problem

To solve the above problem, according to an aspect of the present disclosure, there is provided a method for controlling a plurality of wireless lighting devices, the method including the steps of acquiring coordinate information having the plurality of wireless lighting devices mapped to coordinate values of a coordinate system, generating lighting control information indicating a response of at least one of the plurality of wireless lighting devices to produce a lighting shape of the coordinate system, and transmitting the lighting control information, wherein the lighting control information includes response information and function information, the response information indicates a lighting response of the wireless lighting device, and the function information indicates whether or not the at least one wireless lighting device responds based on the coordinate values.

According to another aspect of the present disclosure, there is provided a device for controlling a plurality of wireless lighting devices, the controlling device including a memory storing data, a communication unit performing communication with an external device, and a processor connected to the memory and the communication unit and operating the controlling device, wherein the processor acquires coordinate information having the plurality of wireless lighting devices mapped to coordinate values of a coordinate system, generates lighting control information indicating a response or non-response of at least one of the plurality of wireless lighting devices to produce a lighting shape of the coordinate system, and transmits the lighting control information, and wherein the lighting control information includes response information and function information, the response information indicates a lighting response of the wireless lighting device, and the function information indicates whether or not the at least one wireless lighting device responds based on the coordinate value.

Advantageous Effects of Disclosure

According to embodiments of the present disclosure, a plurality of wireless lighting devices can be accurately controlled at a high speed, thereby producing versatile and esthetic lighting effects. In addition, according to embodiments of the present disclosure, the quantity of data for controlling the plurality of wireless lighting devices can be minimized, thereby reducing communication loads and increasing processing speeds of a controlling device and controlled devices. The advantageous effects of the present disclosure will be further described through the following example embodiments.

BEST MODE

Figure 1:
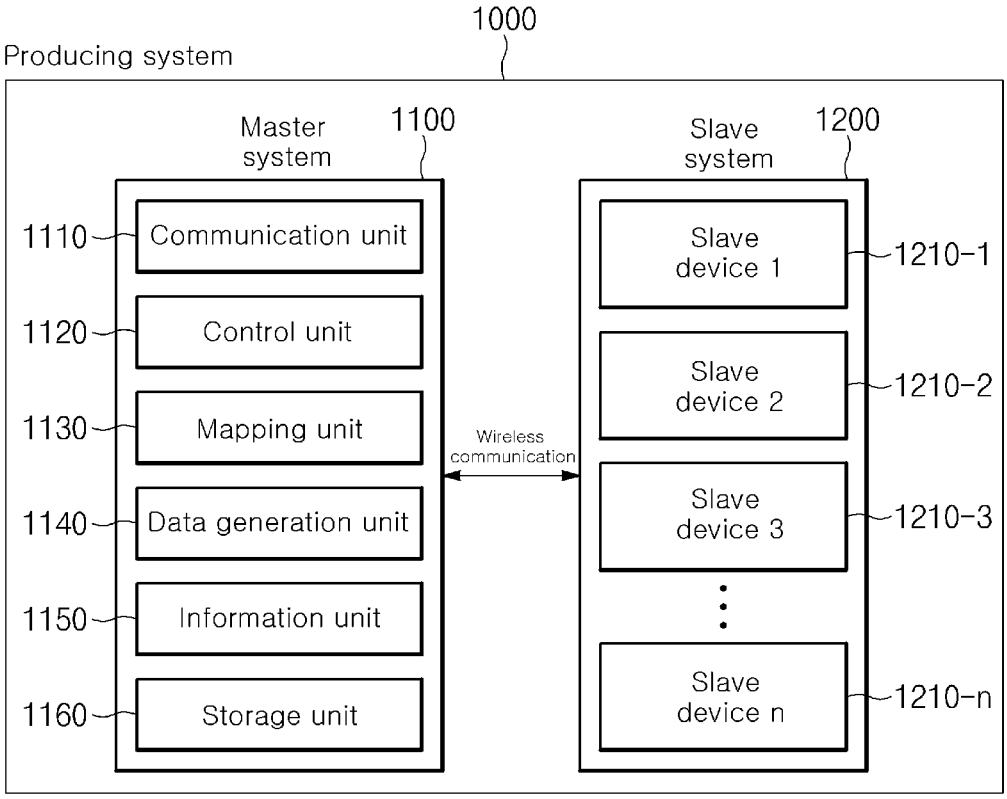
FIG. 1 shows a lighting effect producing system according to an embodiment of the present disclosure.

Reference will now be made in detail to the preferred embodiments of the present invention, examples of which are illustrated in the accompanying drawings. The detailed description, which will be given below with reference to the accompanying drawings, is intended to explain exemplary embodiments of the present invention, rather than to show the only embodiments that can be implemented according to the present invention. The following detailed description includes specific details in order to provide a thorough understanding of the present invention, but all of these specific details may not be necessarily separately used in the present disclosure. Several or all embodiments may be used together, and particular embodiments may be used in combination.

Although most terms used in the present invention have been selected from general ones widely used in the art, some terms have been arbitrarily selected by the applicant and their meanings are explained in detail in the following description as needed. Thus, the present invention should be understood based upon the intended meanings of the terms rather than their simple names or meanings.

The description of the present disclosure relates to a system for producing a lighting effect. The producing system may provide a visual effect having a specific shape or color at indoor/outdoor/virtual performance venues/concert halls. The visual effect may be implemented by controlling lighting of a plurality of wireless lighting devices.

Specifically, the description of the present disclosure relates to a method for allowing a lighting controlling device/system included in a lighting producing system to control the lighting system. In addition, the present disclosure relates to a method for allowing a wireless lighting device of a lighting system to operate in accordance with a command that is wirelessly transmitted from a lighting control system. The lighting control system provides a lighting effect of a lighting system by transmitting a command in a wireless or wired manner. The lighting system includes a plurality of wireless lighting devices.

Described in the present disclosure is a method for controlling a lighting system. In the description of the present disclosure, the lighting system includes a plurality of wireless lighting devices. Each of the plurality of wireless lighting devices enables wireless/wired communication using an arbitrary communication protocol. The lighting system includes the plurality of wireless lighting devices as producing targets.

In the following description, the lighting control system may also be referred to as a master system. The lighting control system and/or the master system may correspond to or may be included in the lighting control device and/or master control device. The lighting system may be referred to as a slave system, and the wireless lighting device may be referred to as a slave device. The lighting control system/device of the present disclosure generates a producing effect by controlling the lighting system. The lighting control system may include a coordinate mapping system.

The wireless lighting device may include a lighting element/device, such as an LCD or an LED or may have a lighting element/device connected thereto, and may refer to an arbitrary electronic device enabling wireless communication. As an example, the wireless lighting device may include a mobile phone, a wireless cheering bar, a lighting stick, or a lighting bar. In the description of the present disclosure, the wireless lighting device may refer to a lighting device, a receiving device, or a slave device. The wireless lighting device may perform wireless communication based on a variety of communication protocols including, for example, Bluetooth, Zigbee, WiFi, Long Term Evolution (LTE), or New Radio (NR).

FIG. 1 shows producing system producing light effect according to an embodiment of the present disclosure.

In the present specification, the producing system 1000 includes a master system 1100 and a slave system 1200.

The master system 1100 may correspond to or may be included in a lighting control device for controlling the plurality of wireless lighting devices.

The master system 1100 includes at least one logic unit selected among a communication unit 1110, a control unit 1120, a mapping unit 1130, a data generation unit 1140, an information unit 1150, and a storage unit 1160. Subordinate units included in the master system 1100 will later be described.

The slave system 1200 includes a plurality of slave devices 1210-1 to **1210-*n*. The slave device 1210** may correspond to or may be included in the wireless lighting device.

The master system 1100 may control the slave system 1200 via wireless communication. A variety of wireless communication protocols may be used for the wireless communication.

Figure 2:
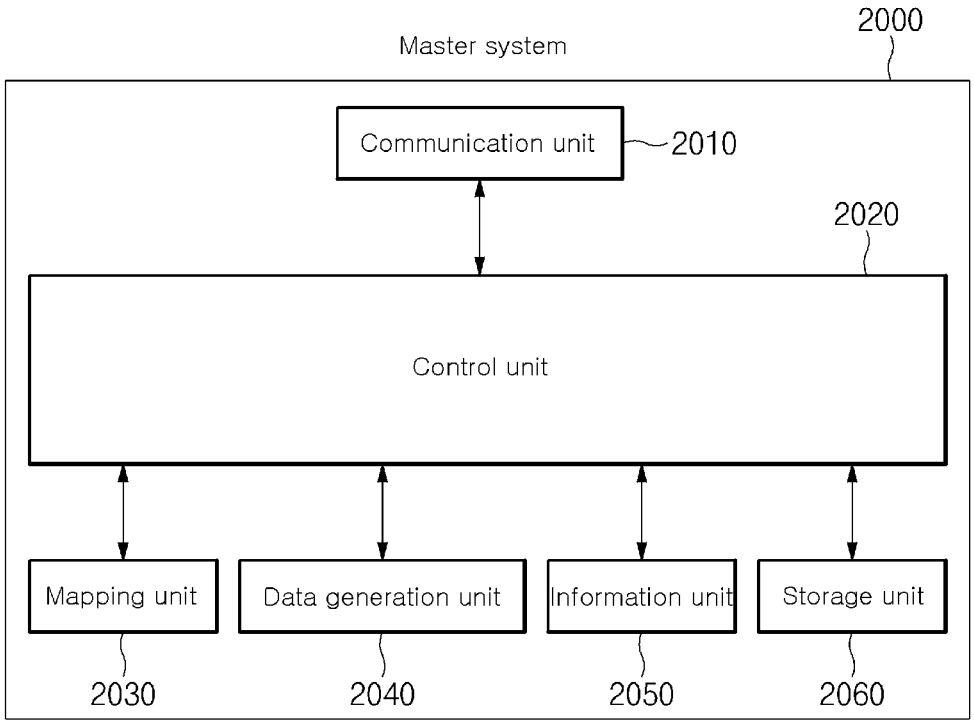
FIG. 2 shows a master system included in the producing system according to an embodiment of the present disclosure.

FIG. 2 shows a master system included in the producing system according to an embodiment of the present disclosure.

The master system 2000 shown in FIG. 2 may correspond to the master system 1100 shown in FIG. 1. The master system 2000 may include at least one of a communication unit 2010, a control unit 2020, a mapping unit 2030, a data generation unit 2040, an information unit 2050, and storage unit 2060.

The communication unit 2010 may perform communication with an external device or a slave device. The control unit 2020 may control the master system or other systems through operation commands. The mapping unit 2030 may transmit database including coordinate information for a specific location to the slave system. The data generation unit 2040 may generate a specific command for controlling the slave system or a packet including the specific command. The information unit 2050 may process the database including coordinate information for a specific location or information for a control operation. The storage unit 2060 may store the database including coordinate information for a specific location and the information for a control operation.

The operation of the master system 2000 will be described below in detail.

Figure 3:
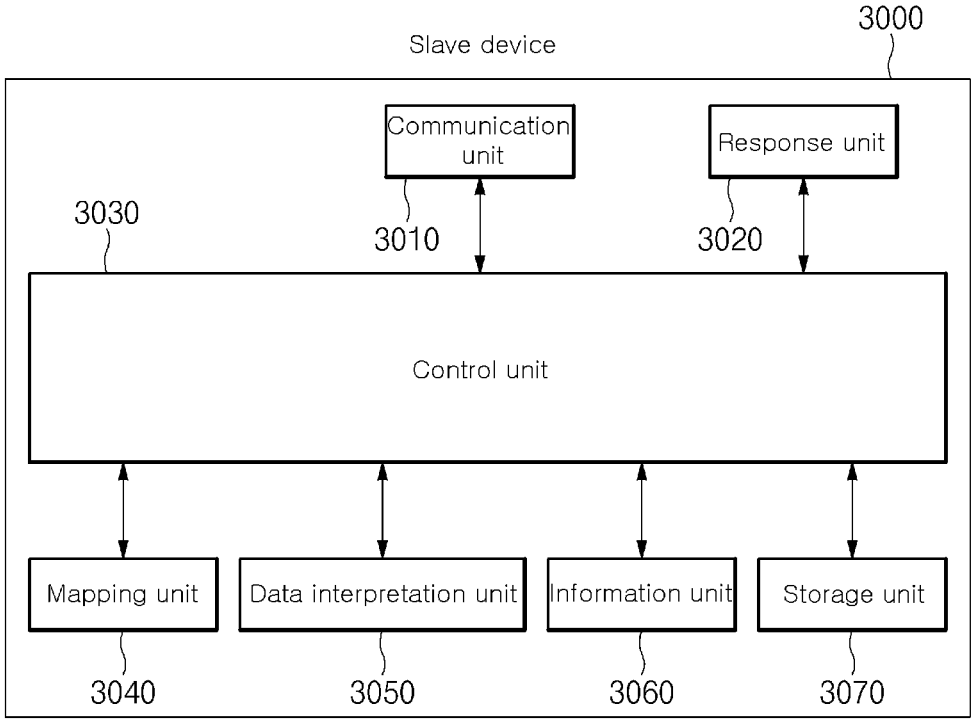
FIG. 3 shows a slave device included in the producing system according to an embodiment of the present disclosure.

FIG. 3 shows a slave device included in the producing system according to an embodiment of the present disclosure.

The slave device 3000 shown in FIG. 3 may correspond to the slave device 1210 shown in FIG. 1. The slave device 3000 may correspond to a wireless lighting device. The slave device 3000 includes at least one of a communication unit 3010, response unit 3020, a control unit 3030, a mapping unit 3040, a data interpretation unit 3050, an information unit 3060, and a storage unit 3070.

The communication unit 3010 may perform communication with an external device or a slave device. The response unit 3020 may provide a response/reaction/feedback, such as lighting, sound or vibration. The control unit 3030 may control the slave system or other systems through operation commands. The mapping unit 3040 may transmit database including coordinate information for a specific location to the slave system or the master system. The data interpretation unit 3050 may analyze/interpret or parse a command or packet for controlling the slave system. The information unit 3060 may process the database including coordinate information for a specific location or information for a control operation. The storage unit 3070 may store the database including coordinate information for a specific location and the information for a control operation.

The operation of the slave device 3000 will be described below in detail.

In the present disclosure, the operation of the lighting producing system may be based on the use of a coordinate system. To produce lighting effects of a variety of shapes, wireless lighting devices possessed by spectators are mapped on a coordinate system, and the lighting effect may be produced/controlled based on the corresponding coordinate system.

Figures 4, 5:
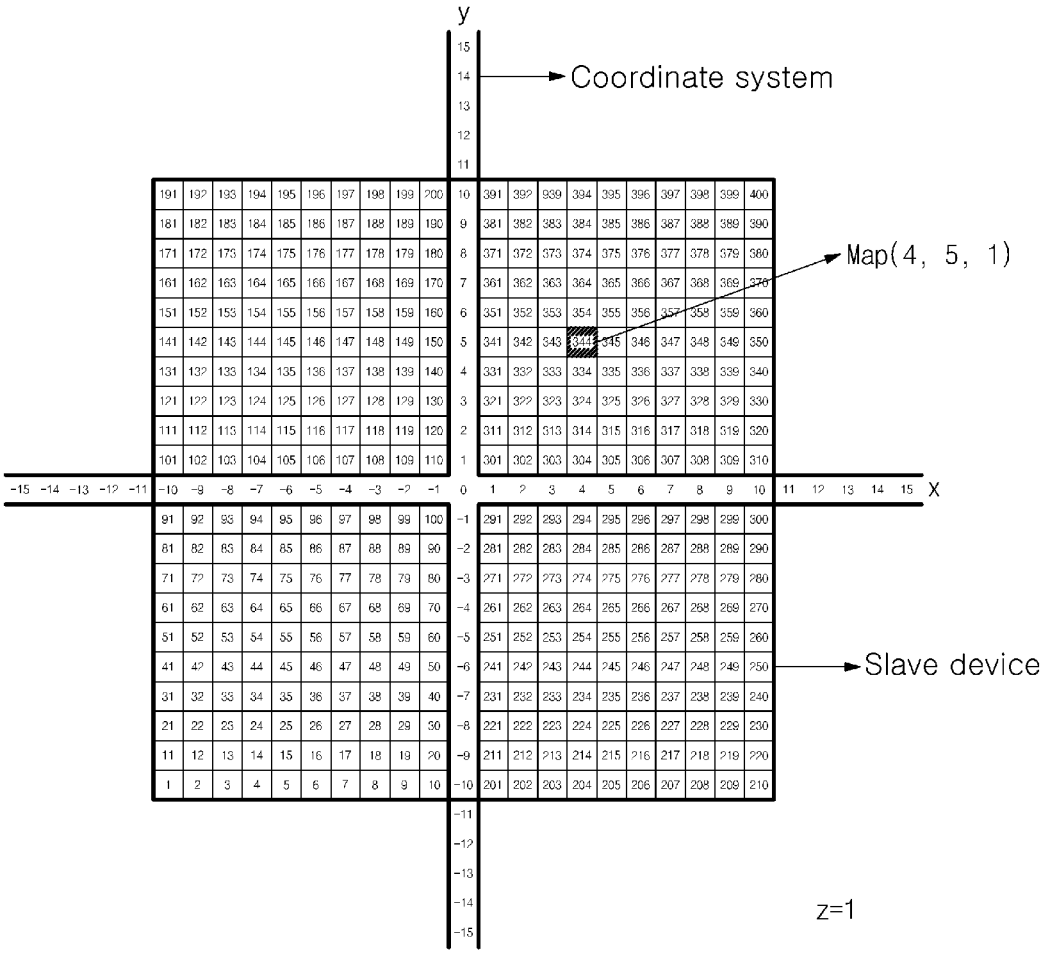
FIG. 4 shows a coordinate system according to an embodiment of the present disclosure.
FIG. 5 shows information for mapping the wireless lighting device according to an embodiment of the present disclosure to specific coordinate values.

FIG. 4 shows a coordinate system according to an embodiment of the present disclosure.

In FIG. 4, a rectangular coordinate system is shown, in which the respective wireless lighting devices or locations of the wireless lighting devices are mapped to 3-dimensional coordinate values. The lighting devices or spectator seats are respectively numbered from 1 to 400. The numbering, total number, and the shape of the coordinate system are provided as a manner or an embodiment, and a various shape of the coordinate system may be used. It may be considered that FIG. 4 shows a 2-dimensional coordinate system included in a 3-dimensional coordinate system where z=1.

The wireless lighting devices and/or the locations of the wireless lighting devices are mapped to coordinate value of the coordinate system. As an embodiment, the locations of the wireless lighting devices may be mapped based on seat locations. As in FIG. 4, the seat numbers corresponding tor the locations of the wireless lighting devices may be mapped to coordinate values, respectively. In FIG. 4, the location of seat number 344 is mapped to a coordinate value (4, 5, 1). In addition, the wireless lighting device owned by the spectator of the corresponding seat number is also mapped to the coordinate value (4, 5, 1).

The operation of mapping the wireless lighting devices to the respective coordinate values may be performed in various manners. As an embodiment, a coordinate value may be preset in a wireless lighting device. As another embodiment, a corresponding coordinate value may be input to a wireless lighting device, and the corresponding coordinate value may be stored in a memory of the wireless lighting device. For example, a control system may enter a coordinate value corresponding to a seat number of a spectator who carries a specific wireless lighting device in the wireless lighting device. Coordinate mapping may be performed by a separate mapping system, and the mapped coordinate system and coordinate mapping information may be transmitted to the lighting control system.

As an embodiment, the control system may transmit a packet required for mapping to the wireless lighting device, and a specific coordinate value may be stored in the wireless lighting device. As an embodiment, coordinate value mapping may also be performed by a separate mapping system.

FIG. 5 shows information for mapping the wireless lighting device according to an embodiment of the present disclosure to specific coordinate values.

The information shown in FIG. 5 may be transmitted in formats of packets in a wired or wireless manner. The information shown in FIG. 5 may be referred to as coordinate mapping information.

The coordinate mapping information shown in FIG. 5 may include at least one of code information, device ID information, coordinate information, time information, and additional information, which will now be described.

The code information indicates product codes. The code information may include at least one of company code information and artist code information.

The device ID information is used to identify a corresponding lighting device as a target. The device ID information allow the corresponding lighting device to be identified using a uniform ID (UID) or a MAC address.

The coordinate mapping information indicates a coordinate value of the coordinate system, to which a location of the target lighting device/lighting device is mapped. The coordinate information may include coordinate values on x, y and z axes. However, the coordinate values may correspond to one of one-dimensional, two-dimensional, three-dimensional coordinate values.

The time information indicates a reference time for a control operation. For example, the time information may indicate time information associated with a corresponding performance.

The additional information provides information other than the information stated above, when necessary. The additional information may be reserved for a later use.

The control system may transmit the coordinate mapping information to the target lighting device to thus map the lighting device to a coordinate value. This operation may be concurrently performed on a plurality of lighting devices.

As described above, if the wireless lighting devices are mapped to coordinate values, the lighting control device transmits lighting control information to control the wireless lighting devices. The lighting control device may transmit different control signals to all of the lighting devices. In this case, however, considerable delays may be caused as the number of devices increases. In particular, since ID information for identifying all of the lighting devices is required, the quantity of control packet data may become massive, resulting in delays in wireless environments.

The lighting control device may classify the lighting devices in groups and may control the lighting devices on a group basis. In this case, however, controlling any group other than predetermined groups cannot be achieved, and a monotonous lighting effect/pattern may be produced. In the present disclosure, a lighting control method, which can provide a wide variety of lighting effects/patterns while transmitting a small quantity of information/packet data, will be explained in greater detail. In the description of the present disclosure, the lighting control information may be referred to as control information or a control packet. The control information may also be contained in the control packet.

Figure 6:
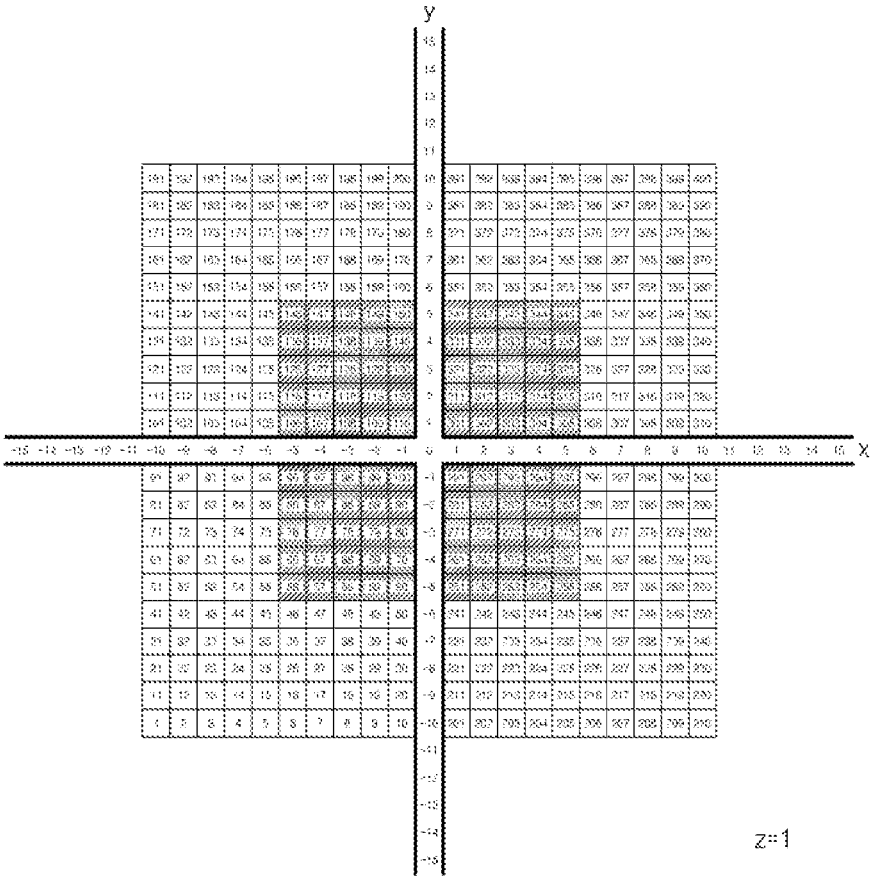
FIG. 6 shows an example lighting shape according to an embodiment of the present disclosure, in which a rectangular lighting shape of a specific color is produced at a central portion.

FIG. 6 shows an example lighting shape according to an embodiment of the present disclosure, in which a rectangular lighting shape of a specific color is produced at a central portion.

In an embodiment, a producing system aims to produce a rectangular red lighting shape. That is to say, 100 seats, which amount to an internal rectangular shape in FIG. 6, are controlled to emit red light.

In an embodiment, it is assumed that a wireless lighting device not responding to the control information is maintained at its previous state. That is to say, in the case where all lighting devices are lit in a yellow color when the controlling of FIG. 6 has yet to be performed, a rectangular red lighting shape on a yellow background may be produced by the controlling of FIG. 6. As another example, in the case where all lighting devices are turned off when the controlling as in FIG. 6 has yet to be performed, a rectangular red lighting shape on a black background may be produced by the controlling of FIG. 6.

In order to produce a rectangular shape, as shown in FIG. 6, lighting devices located at seats corresponding to seat numbers 56-60, 66-70, 76-80, 86-90, 96-100, 106-110, 116-120, 126-130, 136-140, 146-150, 251-255, 261-265, 271-275, 281-285, 291-295, 301-305, 311-315, 321-325, 331-335, and 341-345 need to be lit in a red color.

To this end, control information is to be transmitted to a total of 100 lighting devices. However, to allow the 100 lighting devices to be simultaneously lit, the 100 lighting devices should be identified using the control information transmitted. Accordingly, it is necessary to transmit 100 control packets or a single control packet including 100 pieces of lighting device identification information. In the case where 100 control packets are transmitted, a synchronization problem may arise due to time/frequency delays. In the case where a single control packet including 100 pieces of lighting device identification information is transmitted, the packet size may be large, resulting in a delay in processing the packet(s). In either case, delays caused by data quantity are unavoidable.

Hereinafter, a control method enabling a high-speed lighting control while reducing the packet size will be described.

Figure 7:
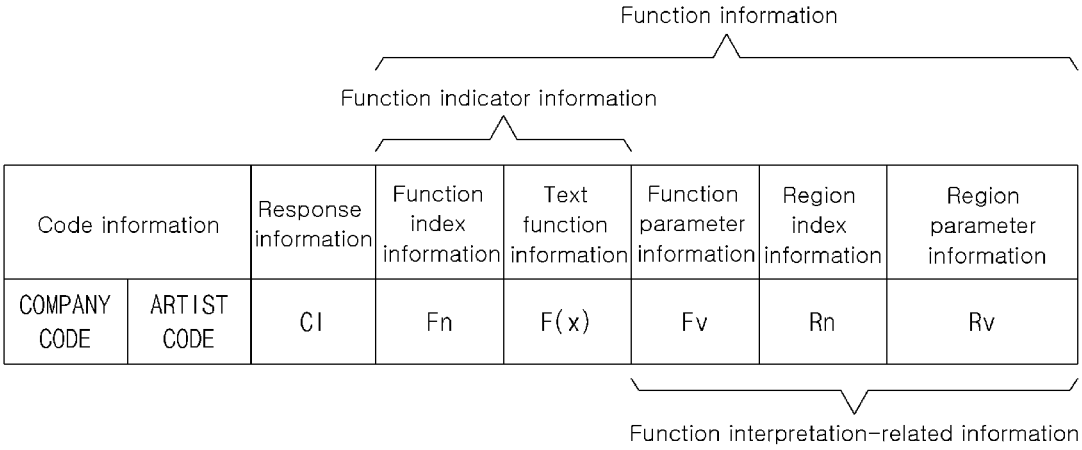
FIG. 7 shows control information according to an embodiment of the present disclosure.

FIG. 7 shows control information according to an embodiment of the present disclosure.

The control information may be referred to as lighting/reaction control information, and may include a lighting response, an acoustic/sound response, or a haptic response as a response/feedback thereof. The following description will focus on a lighting response, and in this case, the control information may be referred to as lighting control information. The control information may correspond to or may be included in a control packet to be transmitted.

As shown in FIG. 7, the control information may include a plurality of pieces of subordinate information/data, and the subordinate information/data may be referred to as fields. That is to say, code information, response information, and function information may be referred to as a code field, a response field and a function field, respectively. The subordinate information of FIG. 7 will now be described.

Code information: The code information is information for identifying a product corresponding to a wireless lighting device. The code information may include at least one of company code information and artist code information. The company code information may be used to identify a device manufacturer or an artist(s)' agency using a corresponding light emitting device. The artist code information may be used to identify the artist(s) using the corresponding light emitting device. It may be determined whether to process or not the control information of the wireless lighting device based on the code information. For example, if the product for the wireless lighting device is not indicated by the code information included in the control information received by the wireless lighting device, the wireless lighting device may discard or ignore the corresponding control information.

Response information: The response information indicates a lighting response of a lighting device. In addition, the response information may additionally indicate at least one response among an acoustic/sound operation and a haptic operation. In the case of the lighting response, the response information may provide color information, such as RGB. The response information may also indicate that a specific sound and/or a specific vibration are output together while the lighting device is lit in a specific color by means of a corresponding packet. In the description of the present disclosure, the lighting response includes light turn-on/turn-off operations.

Function information: The function information indicates whether or not the wireless lighting device responds based on a corresponding coordinate value. The function information may also be referred to as response condition information or lighting condition information in that it indicates whether to respond for each wireless lighting device. The function information provides information for producing a lighting shape. The function information includes function-related information representing lighting shapes having coordinate values of lighting devices as variables. Therefore, the function information may provide a lighting effect of the lighting system. The function information may further include function indicator information and function-related information.

The function indicator information indicates at least one function representing a produced lighting shape. The function-related information may provide additional information for function interpretation/interpretation. The function-related information may also be referred to as function interpretation information. In addition, since the function-related information eventually deduces a variation of a lighting shape determined by the function, it may also be referred to as shape variation information or lighting shape-related information. The produced lighting shape may correspond to or may include at least one of a dot, a line, and a plane. Examples of various lighting shapes represented by the function will be described below.

The function indicator information may include at least one of function index information and text function information.

The function index information indicates at least one of a plurality of functions corresponding to the lighting shapes produced by the lighting system by controlling lighting. Examples of lighting shapes represented by functions will later be described. The function index information may indicate a function index of a corresponding function when the plurality of functions are preset/prestored. When a list of functions is shared by the control device and the wireless lighting device, a specific function may be indicated by only a function index. Therefore, the quantity of data transmitted and received may be reduced.

The text function information describes a text interpretation type function. The text function information may directly describe functions other than the functions that can be indicated by the indexes.

The function-related information may include at least one of function parameter information, region index information, and region parameter information. The control system may change the lighting shape on the coordinate system represented by the functions by changing at least one of the function parameter information, the region index information, and the region parameter information.

The function parameter/factor information indicates/provides function parameter values. The function parameter values are parameter/factor/element values required for function interpretation. The function parameter information may be used in determining lighting shapes represented by functions or shape variations.

The region index information indicates a function interpretation mode. The region index information may include index values of ranges required in determining function ranges after function interpretation and may be used in determining the range of lighting shapes represented by the functions. As an embodiment, the region index information may indicate function ranges including, for example, 1(=), 2(≠), 3(<), 4(>), 5(≤), 6(≥), 7(≠≤), and 8(≠≥). The region index information indicates values corresponding to digit numbers ranging from 1 to 8, and the lighting device may analyze/interpret functions by setting region indexes of the corresponding digit numbers. As another embodiment, the region index information may directly provide an indication of regions, such as =, ≠, <, or >, without using indexes. Therefore, the region index information may also be referred to as region information. The region information indicates a relationship between the left side and the right side for true/false determination in the function interpretation.

The region parameter information indicates parameter values required for determining function ranges after the function interpretation. The region parameter information may also indicate scales of lighting shapes represented by functions. Scaling of functions may be associated with scaling of lighting shapes.

The function information included in the lighting control information represents lighting shapes intended to produce, and also represents responses of lighting devices for producing the lighting shapes using coordinate values at the same time. The method for producing light shapes based on the lighting control information will now be described in more detail.

Figure 8:
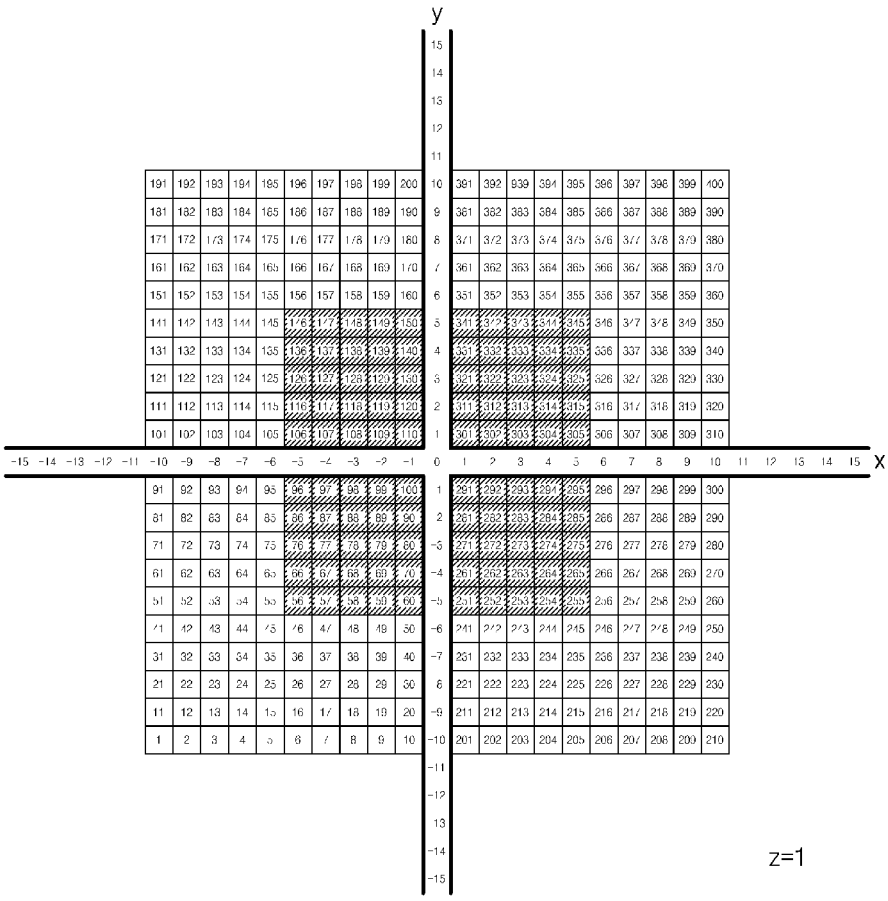
FIG. 8 shows control information used in producing the lighting shape shown in FIG. 6 and a lighting shape based on the control information, according to an embodiment of the present disclosure.

FIG. 8 shows control information used in producing the lighting shape shown in FIG. 6 and a lighting shape based on the control information, according to an embodiment of the present disclosure.

The control information of FIG. 8(*a*) will be described as follows.

Code information: The code information indicates A1. This may correspond to a code of company A's artist 1.

Response information: The response information corresponds to (255, 0, 0, 0). In the example shown in FIG. 8, the response information indicates a color, and (255, 0, 0, 0) indicates a red color.

Function index information: The function index indicates a function numbered a pre-allocated value 1. In the example shown in FIG. 8, the function 1 is expressed as follows:

$$|(x-a)+(y-b)|+|(x-a)-(y-b)|=d. \quad \text{Function 1:}$$

Function name information: The function name information indicates that no text interpretation algorithm function will be used. Values of the function name information may include a null value and an arbitrary value.

Function parameter information: The function parameter information indicates that parameter values required for function interpretation are a=0 and b=0.

Region index information: The region index information indicates 5(≤). When the function is in the range of smaller than or equal to d, the function is true. That is to say, when the operation result value of the left side of the function 1 is smaller than or equal to d, the function is determined to be true.

Region parameter information: The region parameter information has a region parameter value d of being 10.

The wireless lighting device applies its coordinate value to a corresponding function, and determines to respond when the operation result of the corresponding function is true. That is to say, the control information of FIG. 8(*a*) provides the following conditional expression by the function 1:

$$(x-0)+(y-0)|+|(x-0)-(y-0)|\leq 10.$$

Referring back to FIG. 6, the seat number 1 is mapped to a coordinate value (−10, −10, 1). When this coordinate value is applied to the function 1, the processing result is as follows:

$$|(-10-0)+(-10-b)|+|(-10-0)-(-10-0)|=20.$$

When the left side of the expression is compared with the conditional expression of the function 1, 20≤10 is determined to be false, and thus the wireless lighting device of the seat number 1 will not respond.

Referring again to FIG. 6, the seat number 301 is mapped to a coordinate value (1, 1, 1). When this coordinate value is applied to the function 1, the processing result is as follows:

$$|(1-0)+(1-0)|+|(1-0)-(1-0)|=2.$$

When the left side of the expression is compared with the conditional expression of the function 1, 2≤10 is determined to be true, and thus the wireless lighting device of the seat number 301 will be lit in a red color.

In such a manner, all wireless lighting devices having received the control information of FIG. 8 apply their coordinate values to process the function information and then determine whether to respond to the received control information or not, according to the processing result. The lighting devices having determined to respond in the same manner as in the aforementioned example may simultaneously respond, thereby producing the rectangular red lighting effects, as shown in FIG. 8(*b*).

FIG. 9 shows lighting effects produced based on the control information, according to another embodiment of the present disclosure.

Figure 9A:
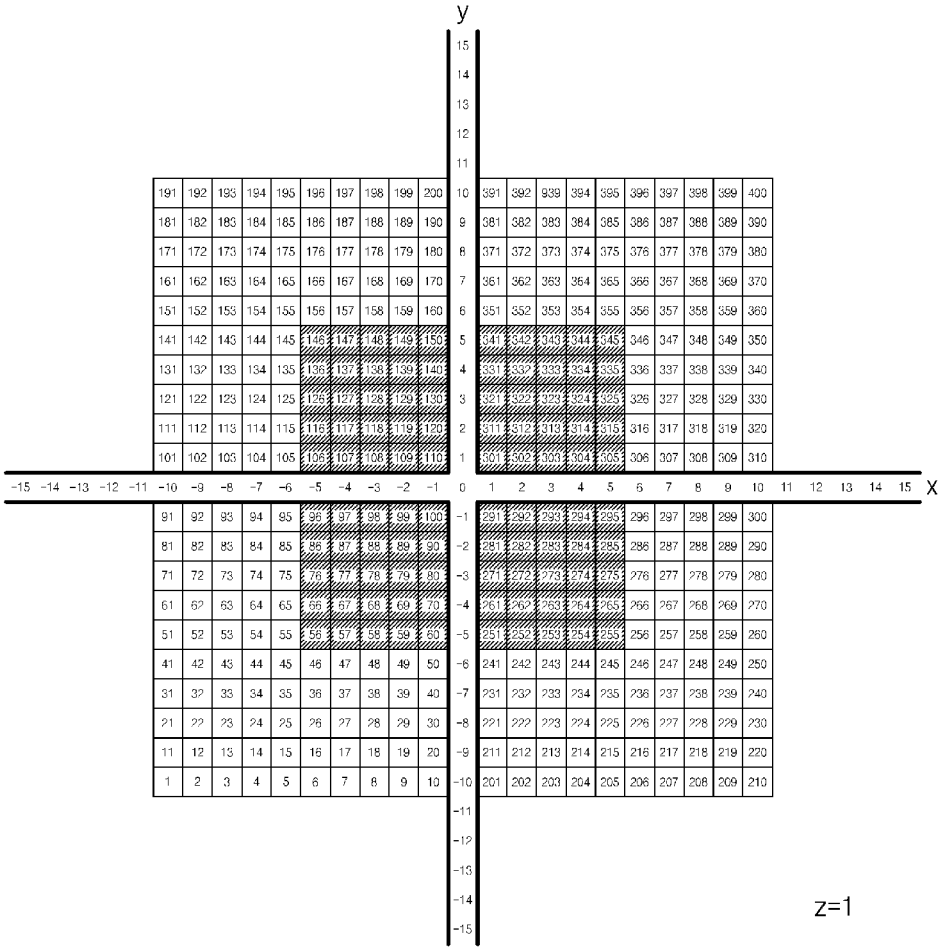
FIG. 9A shows lighting effects produced based on the control information, according to another embodiment of the present disclosure.
Figure 9B:
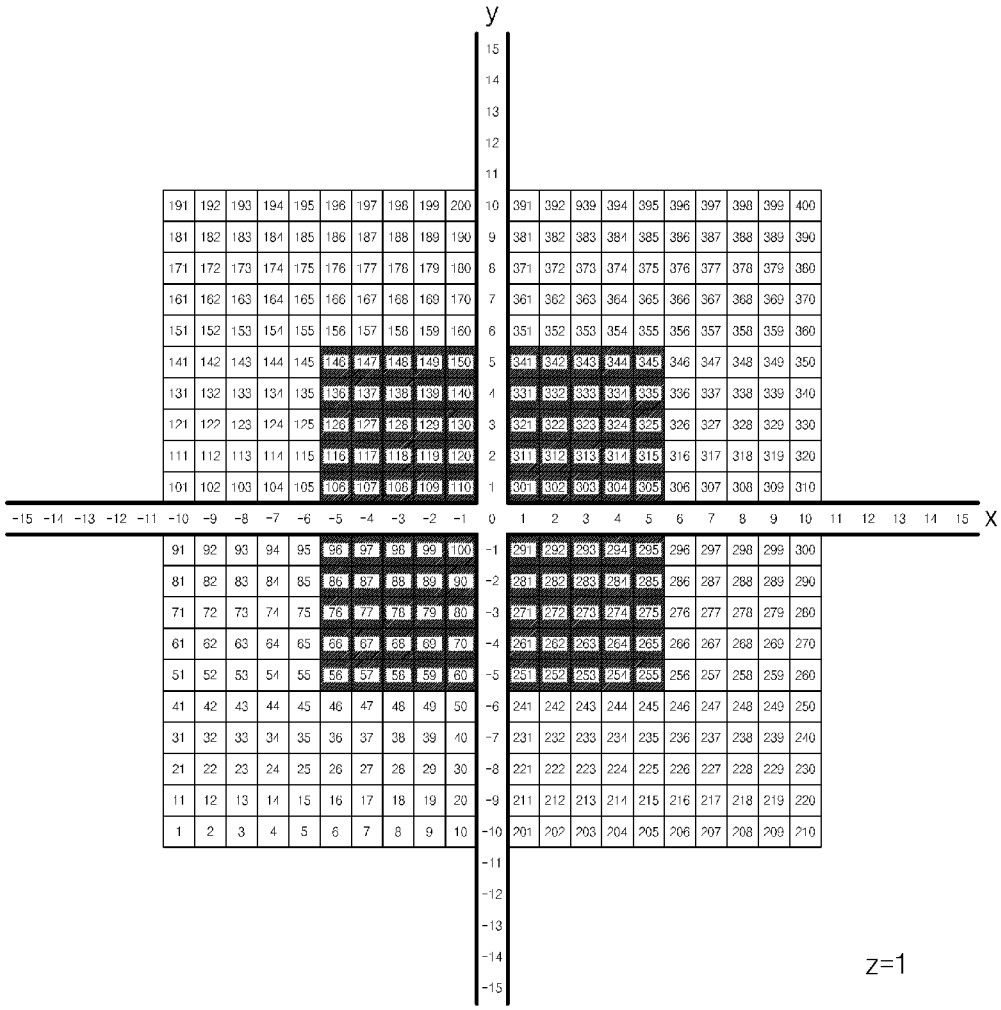
FIG. 9B shows lighting effects produced based on the control information, according to another embodiment of the present disclosure.
Figure 9C:
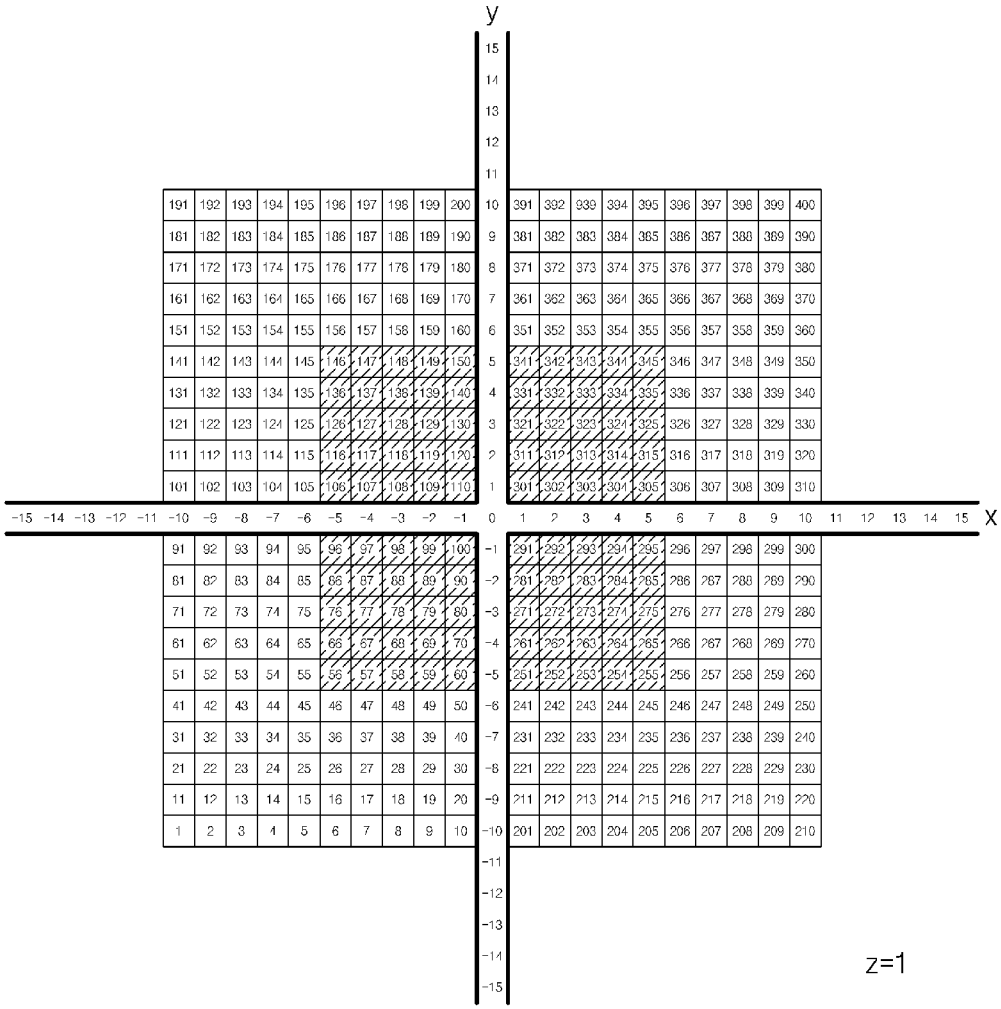
FIG. 9C shows lighting effects produced based on the control information, according to another embodiment of the present disclosure.
Figure 9D:
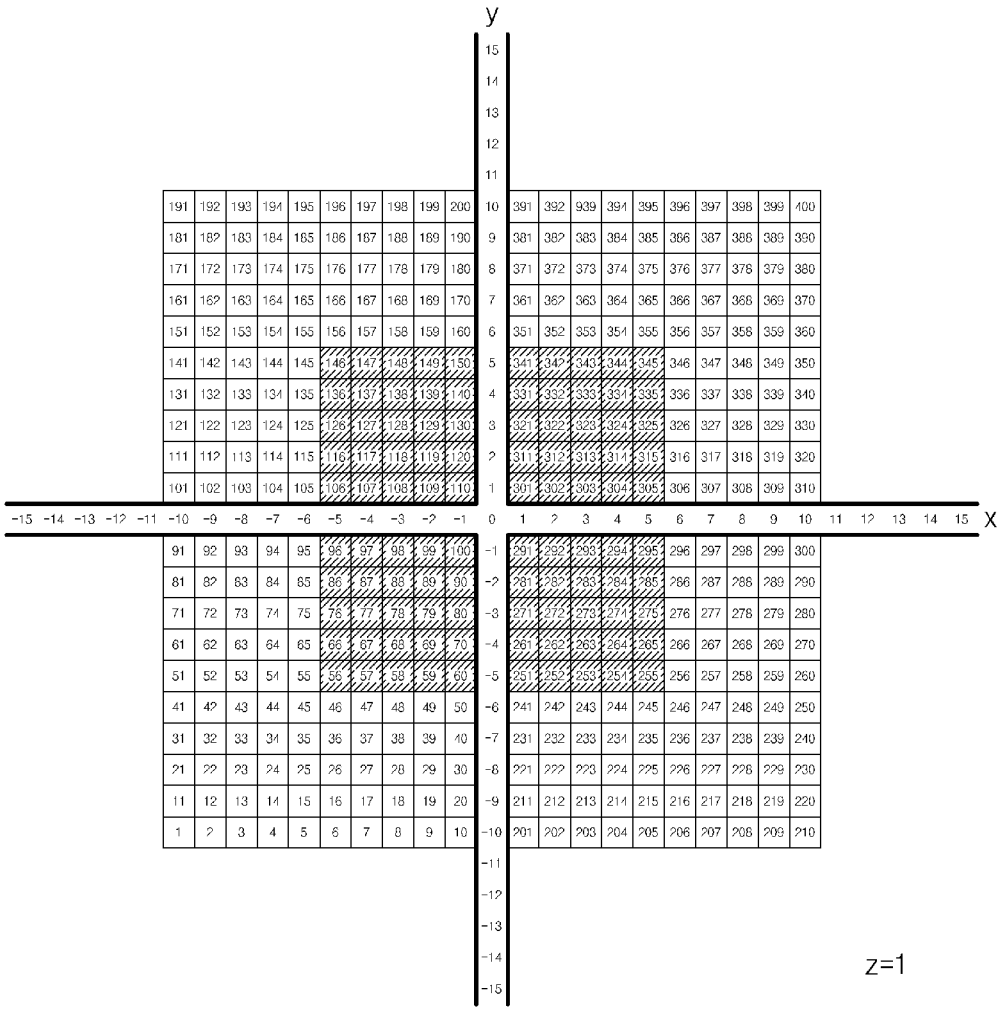
FIG. 9D shows lighting effects produced based on the control information, according to another embodiment of the present disclosure.

In FIGS. 9A to 9D, examples with only the response information changed in the example control information of FIG. 8, are shown. That is to say, FIG. 9A shows an example in which the response information corresponds to (0, 255, 0, 0), FIG. 9B shows an example in which the response information corresponds to (0, 0, 255, 0), FIG. 9C shows an example in which the response information corresponds to (255, 255, 0, 0), and FIG. 9D shows an example in which the response information corresponds to (0, 255, 255, 0), respectively. According to the extent of each response, as shown in FIGS. 9A to 9D, the lighting devices corresponding to the coordinate values of rectangular shape can be lit in different colors. The lighting devices displayed in the example of FIG. 9A can be lit in a green color. In addition, the lighting devices displayed in the example of FIG. 9B can be lit in a blue color. In addition, the lighting devices displayed in the example of FIG. 9C can be lit in a yellow color. In addition, the lighting devices displayed in the example of FIG. 9D can be lit in a sky blue color.

The formats of the response information are provided only by way of example, and additional information about a variety of colors can be provided using arbitrary data formats. For example, the response information may additionally indicate not only lighting colors but also responses, such as an output sound or an output vibration, using bit values. As an embodiment, the response information may have a value '00010110' and may additionally indicate a color by the preceding four bits, an output audio by the following two bits and an output vibration by the last two bits.

FIG. 10 shows lighting effects produced based on the control information, according to another embodiment of the present disclosure.

Specifically, FIG. 10 shows an example in which function parameter information of function information included in the control information is changed. That is to say, examples in which only the function parameter information is changed in the control information of FIG. 8, are shown in FIGS. 10A to 10D. FIG. 10A shows an example in which the function parameter information of the function information of FIG. 8 corresponds to a case where a=−5 and b=5, FIG. 10B shows an example in which the function parameter information of the function information of FIG. 8 corresponds to a case where a=5 and b=5, FIG. 10C shows an example in which the function parameter information of the function information of FIG. 8 corresponds to a case where a=−5 and b=−5, and FIG. 10D shows an example in which the function parameter information of the function information of FIG. 8 corresponds to a case where a=5 and b=−5, respectively.

An operation for controlling a wireless lighting device will now be described by way of example with regard to the case of FIG. 10B.

Function index information: The function index information indicates a function numbered a pre-allocated number 1. As described above in FIG. 8, the function 1 is expressed as follows:

$$|(x-a)+(y-b)|+|(x-a)-(y-b)|=d. \quad \text{Function 1:}$$

Function name information: The function name information indicates that no text interpretation algorithm function will be used. Values of the function name information may include a null value and an arbitrary value.

Function parameter information: The function parameter information indicates that parameter values required for function interpretation are a=5 and b=5.

Region index information: When the region index is in the range of smaller than or equal to d, the function is true. That is to say, when an operation result value of the left side of the function 1 is smaller than or equal to d, the function is determined to be true.

Region parameter information: The region parameter information has a region parameter value d of being 10.

Each lighting device applies its coordinate value to a corresponding function, and determines to respond when the operation result of the corresponding function is true. That is to say, the control information of FIG. 8 provides the following condition by the function 1:

$$|(x-5)+(y-5)|+|(x-5)-(y-5)|\leq 10.$$

Figure 10A:
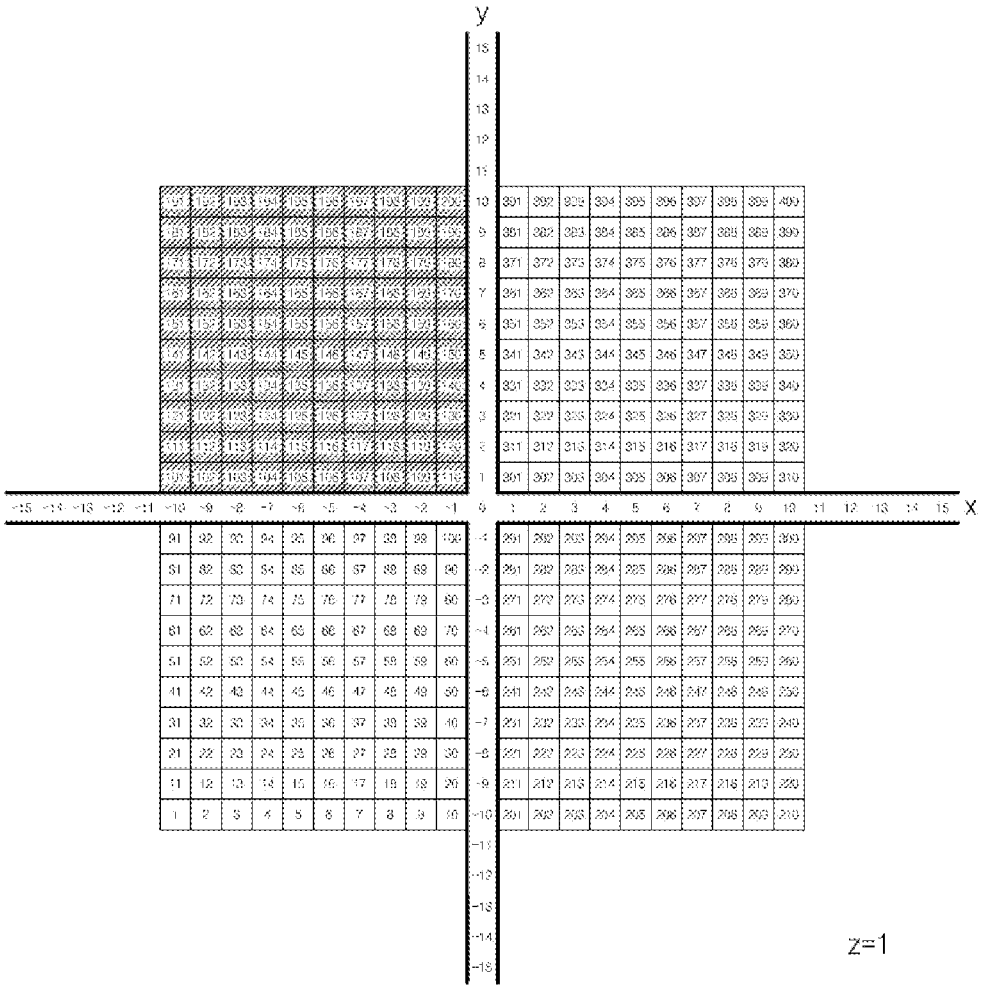
FIG. 10A shows lighting effects produced based on the control information, according to another embodiment of the present disclosure.
Figure 10B:
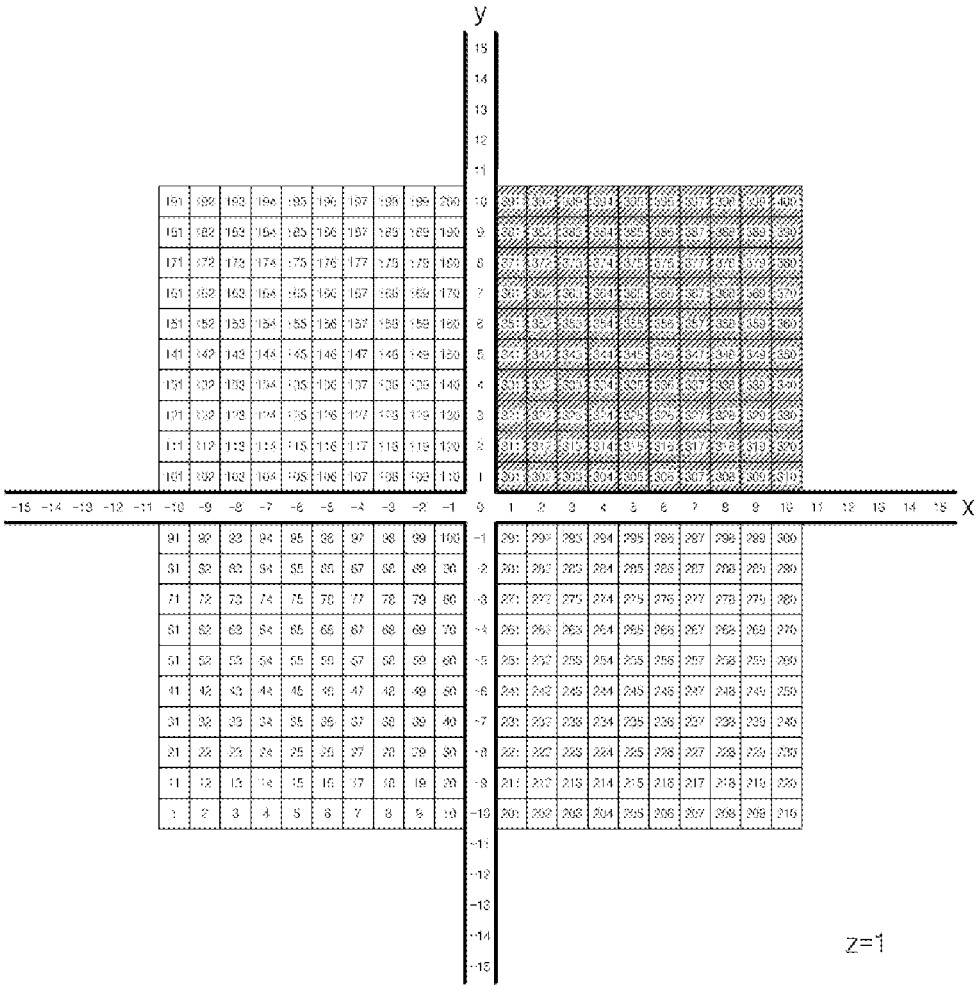
FIG. 10B shows lighting effects produced based on the control information, according to another embodiment of the present disclosure.
Figure 10C:
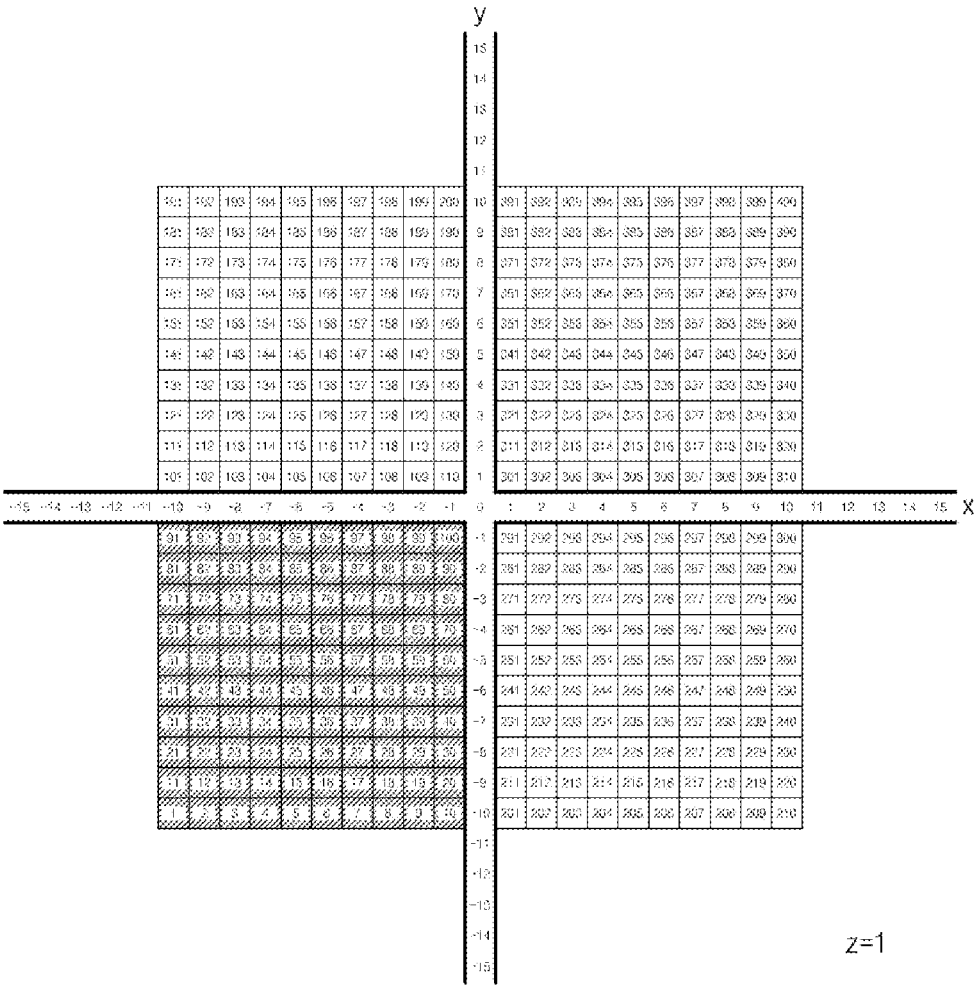
FIG. 10C shows lighting effects produced based on the control information, according to another embodiment of the present disclosure.
Figure 10D:
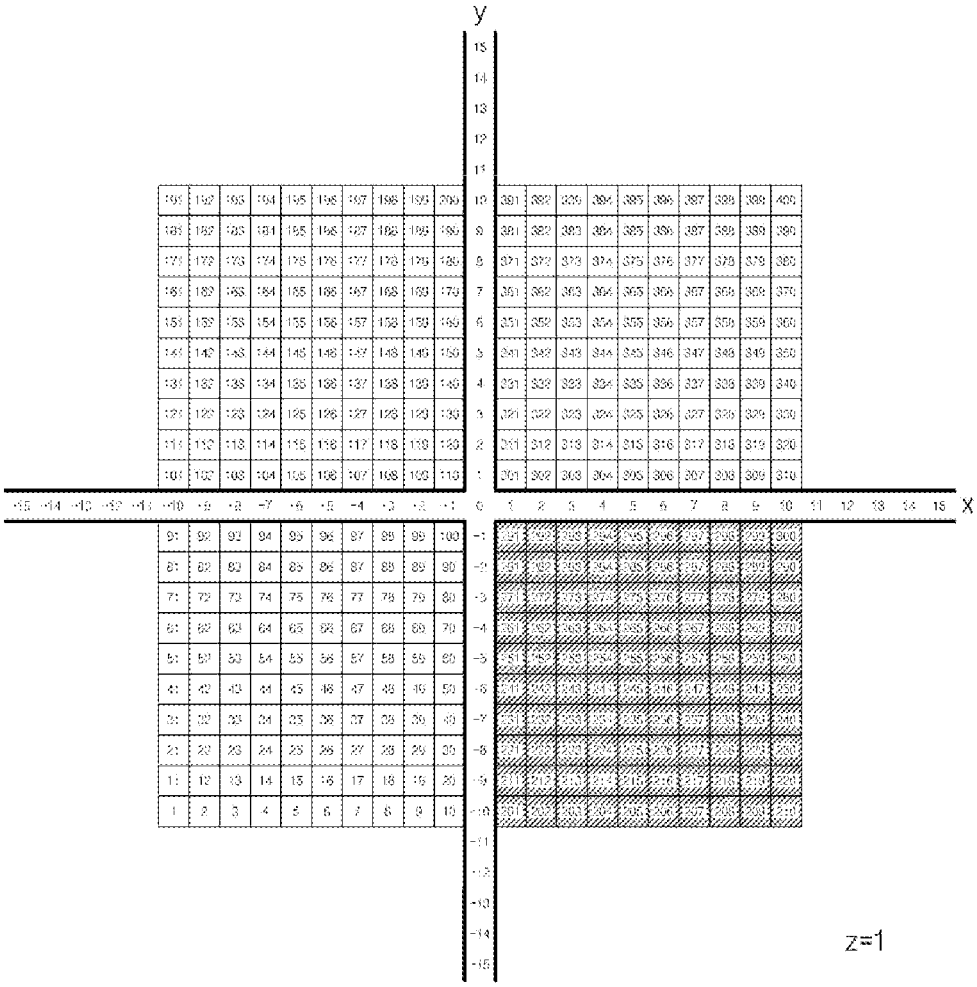
FIG. 10D shows lighting effects produced based on the control information, according to another embodiment of the present disclosure.

Referring to FIG. 10B, the seat number 1 is mapped to a coordinate value (−10, −10, 1). When this coordinate value is applied to the function 1, the processing result is as follows:

$$|(-10-5)=(-10-5)|+|(-10-5)-(-10-5)|=30.$$

When the left side of the expression is compared with the conditional expression of the function 1, 30≤10 is determined to be false, and thus the lighting device of the seat number 1 will not respond.

Referring again to FIG. 10B, the seat number 301 is mapped to a coordinate value (1, 1, 1). When this coordinate value is applied to the function 1, the processing result is as follows:

$$|(1-5)+(1-5)|+|(1-5)-(1-5)|=8.$$

When the left side of the expression is compared with the conditional expression of the function 1, 8≤10 is determined to be true, and thus the lighting device of the seat number 301 will be lit in a red color.

In such a manner, all of the lighting devices having received the control information of FIG. 10B apply their coordinate values to process the function information and then determine whether to respond to the received control information or not, according to the processing result. The lighting devices having determined to respond in the same manner as in the aforementioned example may simultaneously respond, thereby producing the rectangular red lighting effect, as shown in FIG. 10B, which is positioned at a right top side of the entire coordinate system.

FIG. 11 shows lighting effects produced based on the control information, according to another embodiment of the present disclosure.

Specifically, FIG. 11 shows examples in which only the region index information included in the function information is changed. That is to say, examples, in which only the region index information in the control information of FIG. 8 is changed, are shown in FIGS. 11A to 11H. FIG. 11A shows an example in which the region index information in the function information of FIG. 8 has a value 1, indicating "=" (equal), FIG. 11B shows an example in which the region index information in the function information of FIG. 8 has a value 2, indicating "≠" (not equal), FIG. 11C shows an example in which the region index information in the function information of FIG. 8 has a value 3, indicating "<" (smaller), FIG. 11D shows an example in which the region index information in the function information of FIG. 8 has a value 4, indicating ">" (larger), FIG. 11E shows an example in which the region index information in the function information of FIG. 8 has a value 5, indicating "≤" (smaller or equal), FIG. 11F shows an example in which the region index information in the function information of FIG. 8 has a value 6, indicating "≥" (larger or equal), FIG. 11G shows an example in which the region index information in the function information of FIG. 8 has a value 7, indicating "≠≤" (smaller or not equal), FIG. 11H shows an example in which the region index information in the function information of FIG. 8 has a value 8, indicating "≠≥" (larger or not equal), respectively.

Figure 11A:
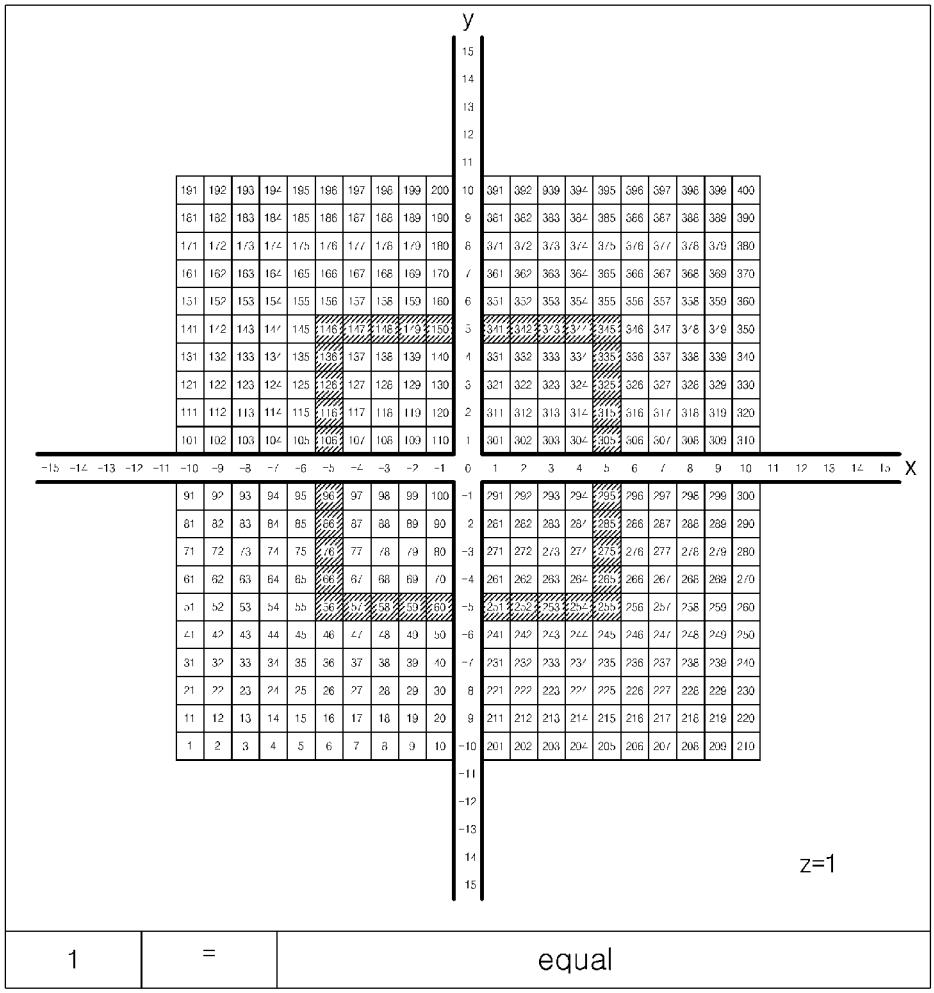
FIG. 11A shows lighting effects produced based on the control information, according to another embodiment of the present disclosure.
Figure 11B:
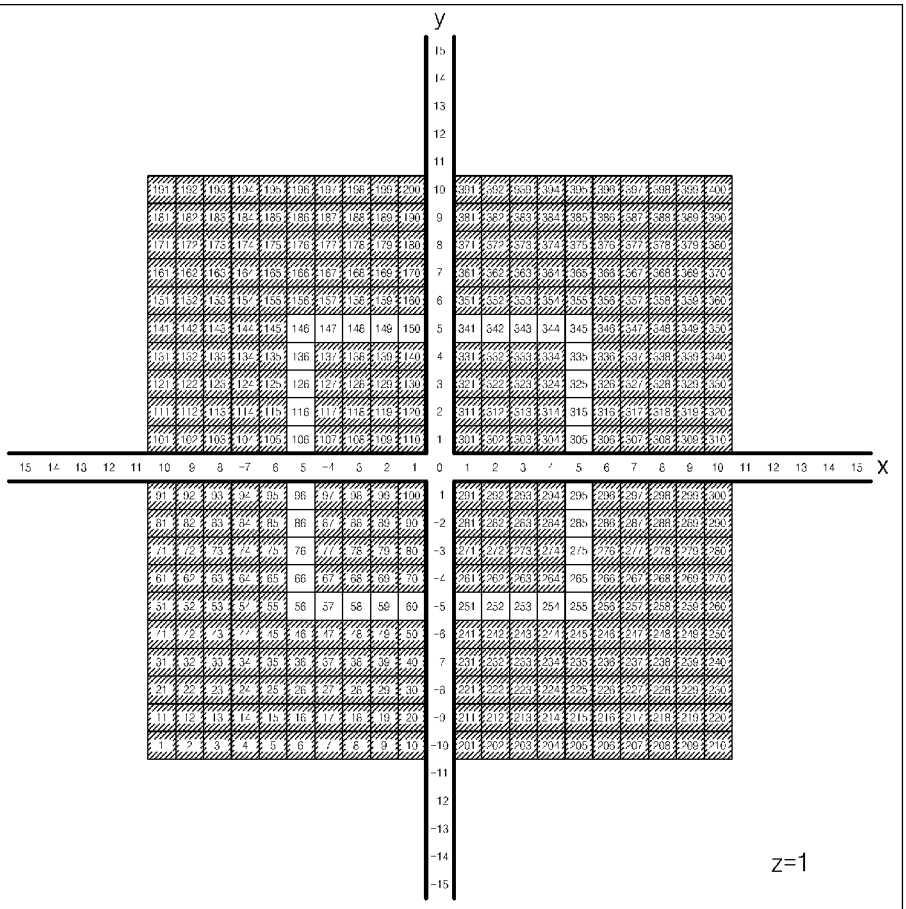
FIG. 11B shows lighting effects produced based on the control information, according to another embodiment of the present disclosure.
Figure 11C:
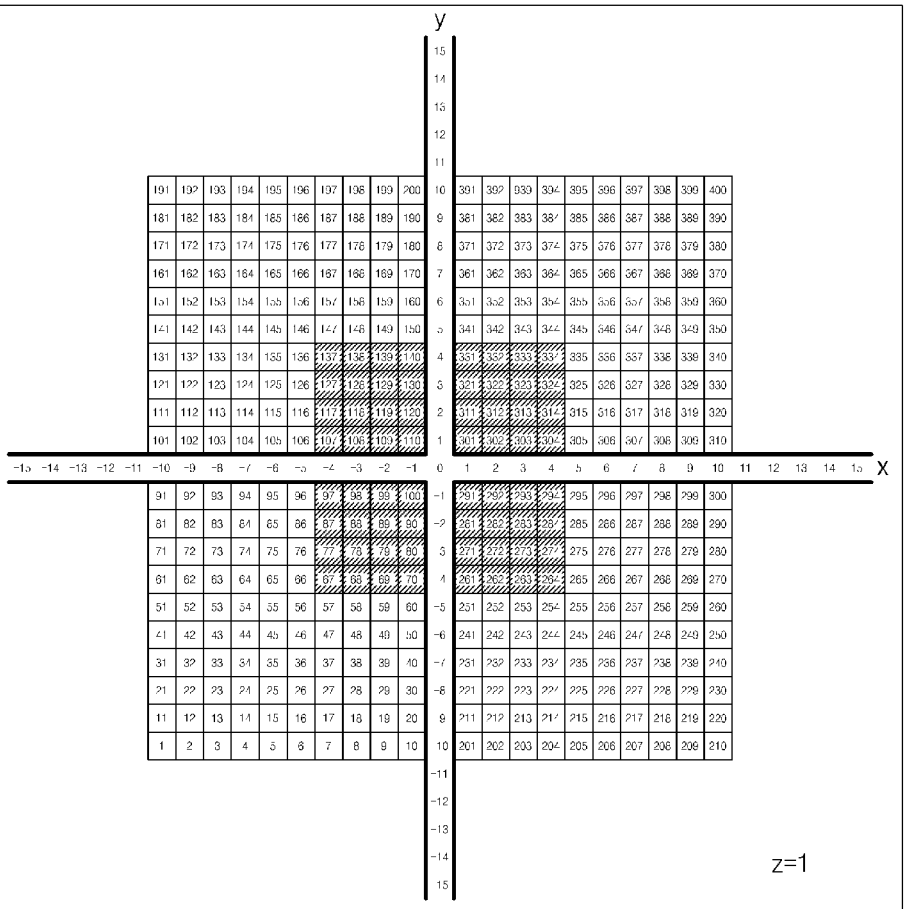
FIG. 11C shows lighting effects produced based on the control information, according to another embodiment of the present disclosure.
Figure 11D:
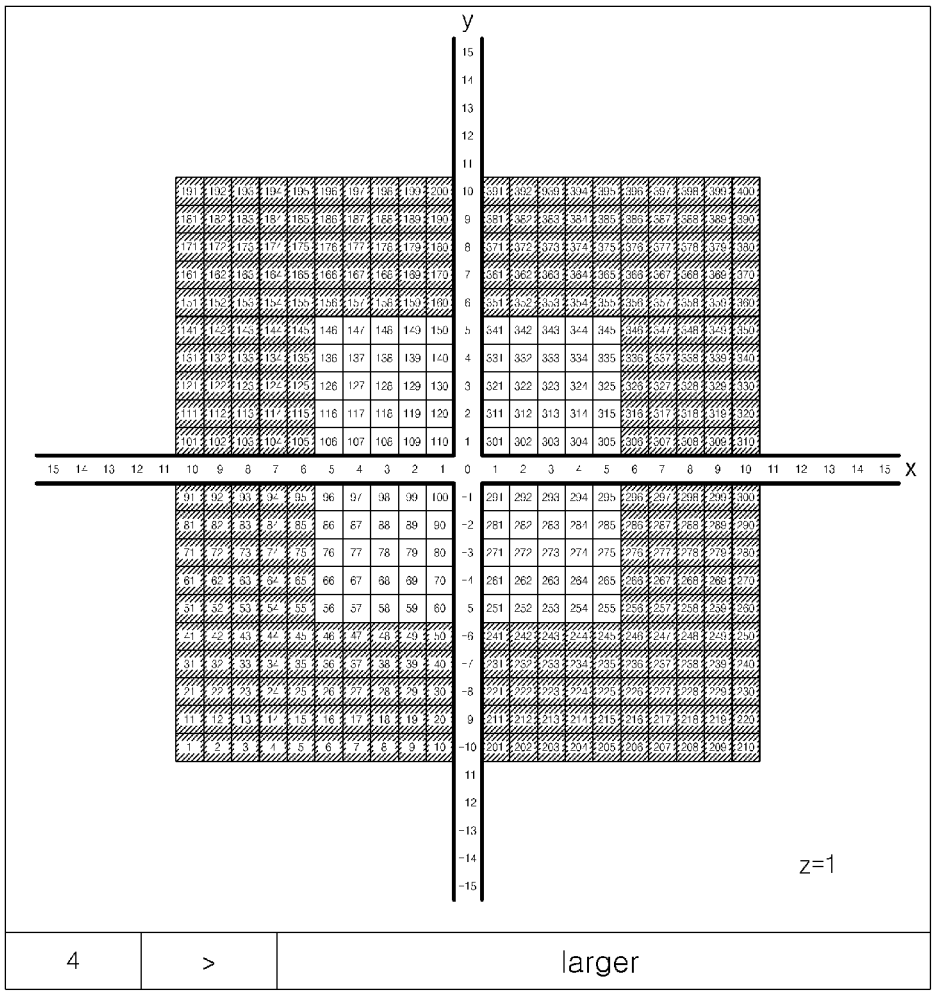
FIG. 11D shows lighting effects produced based on the control information, according to another embodiment of the present disclosure.
Figure 11E:
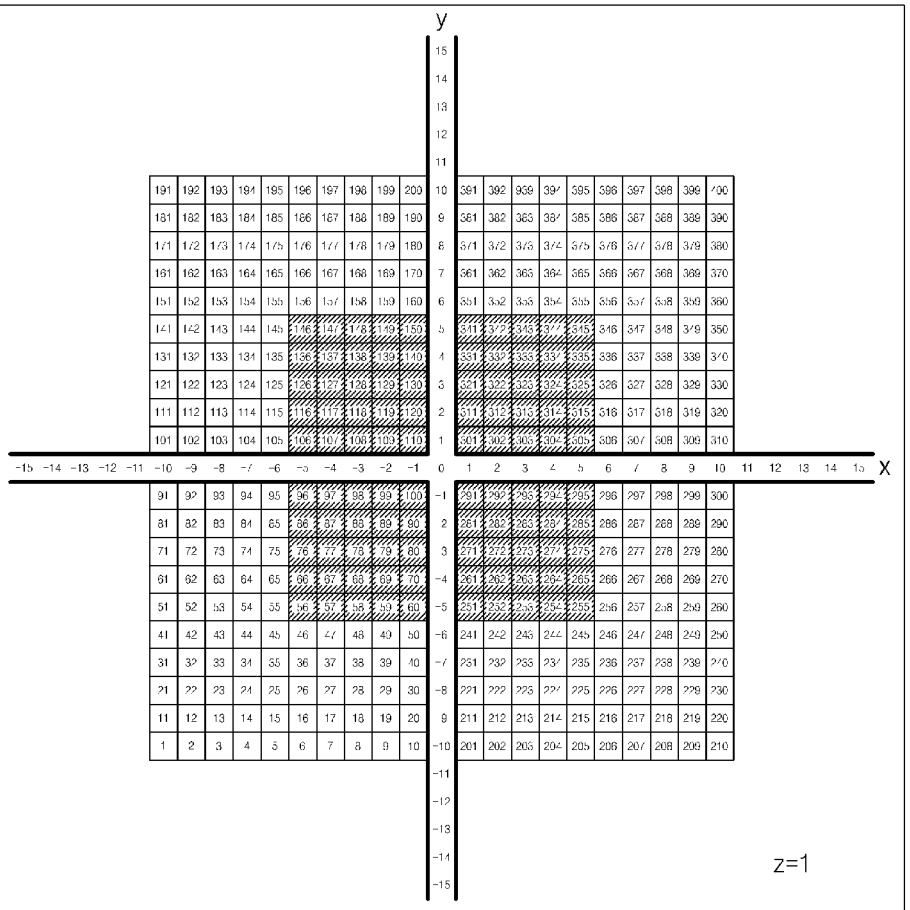
FIG. 11E shows lighting effects produced based on the control information, according to another embodiment of the present disclosure.
Figure 11F:
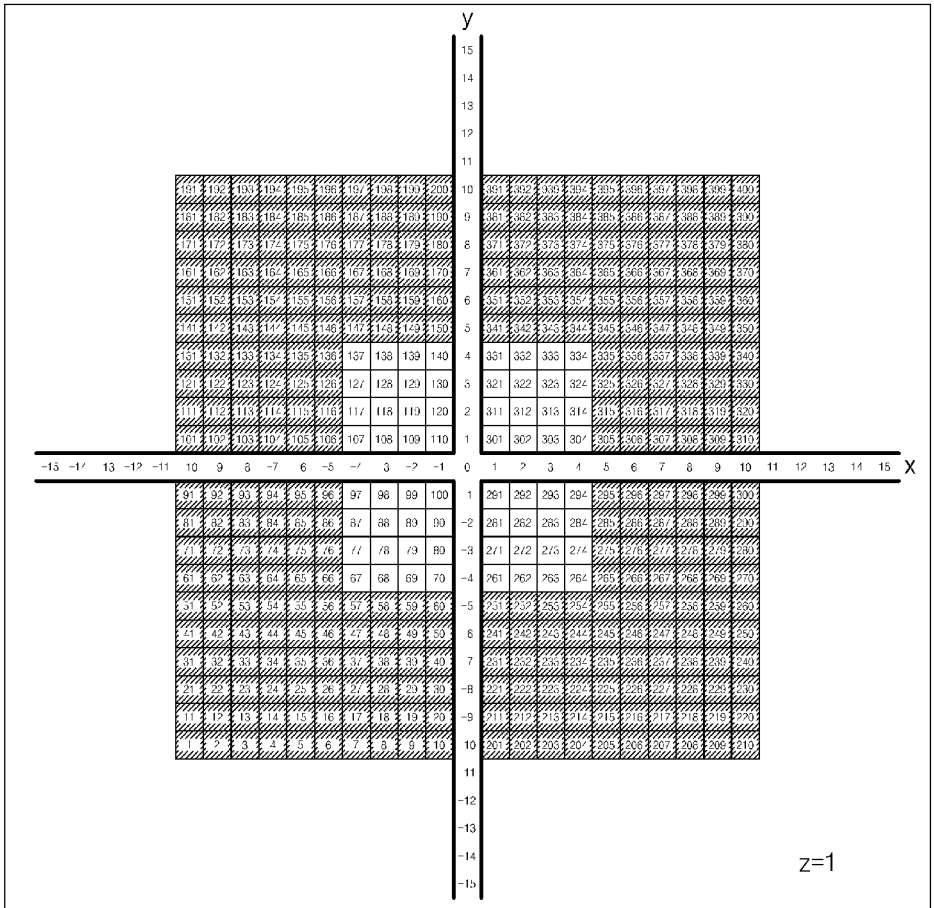
FIG. 11F shows lighting effects produced based on the control information, according to another embodiment of the present disclosure.
Figure 11G:
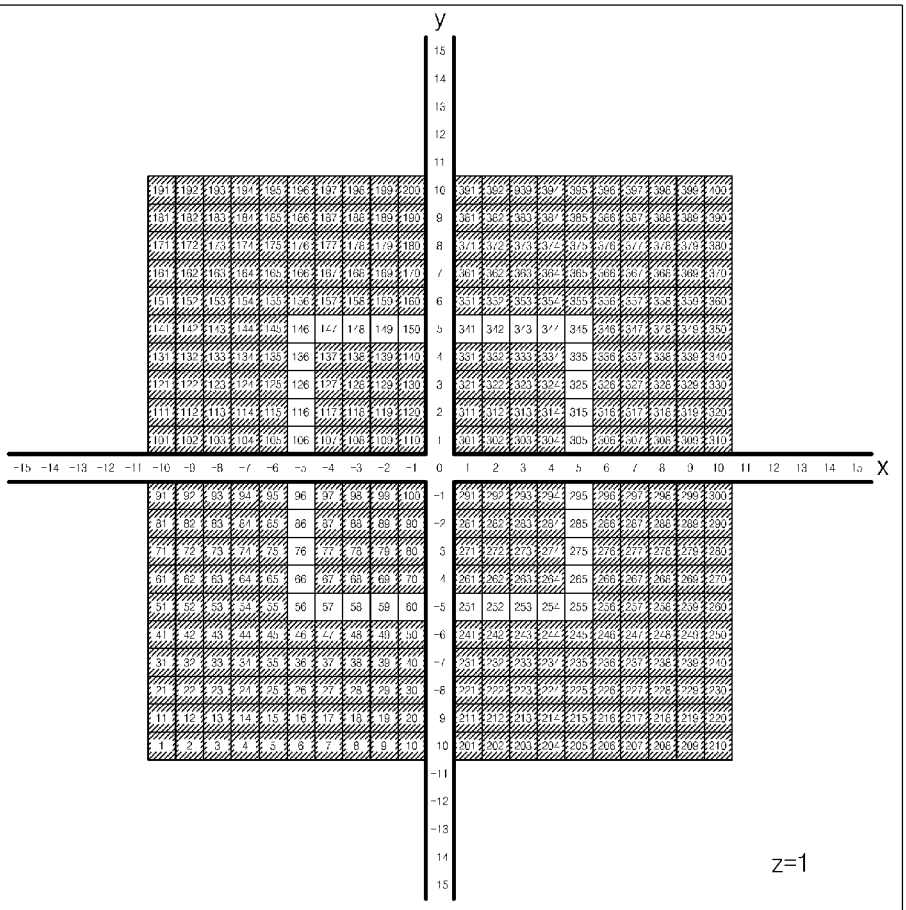
FIG. 11G shows lighting effects produced based on the control information, according to another embodiment of the present disclosure.
Figure 11H:
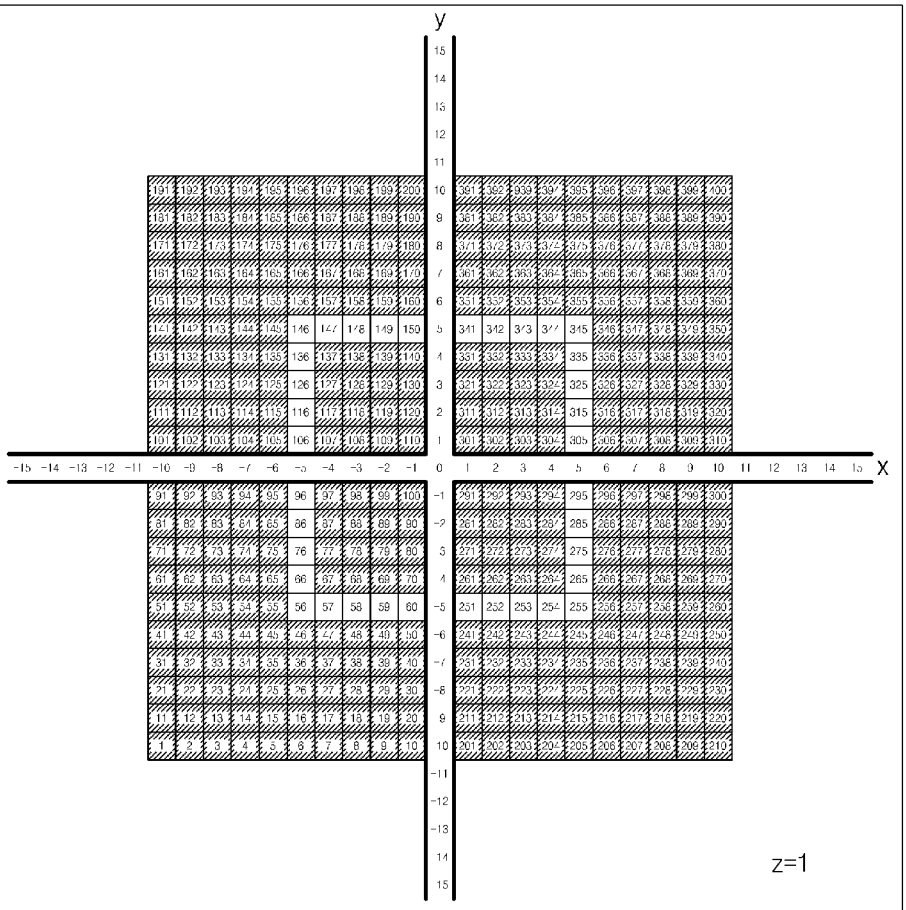
FIG. 11H shows lighting effects produced based on the control information, according to another embodiment of the present disclosure.
Figure 12A:
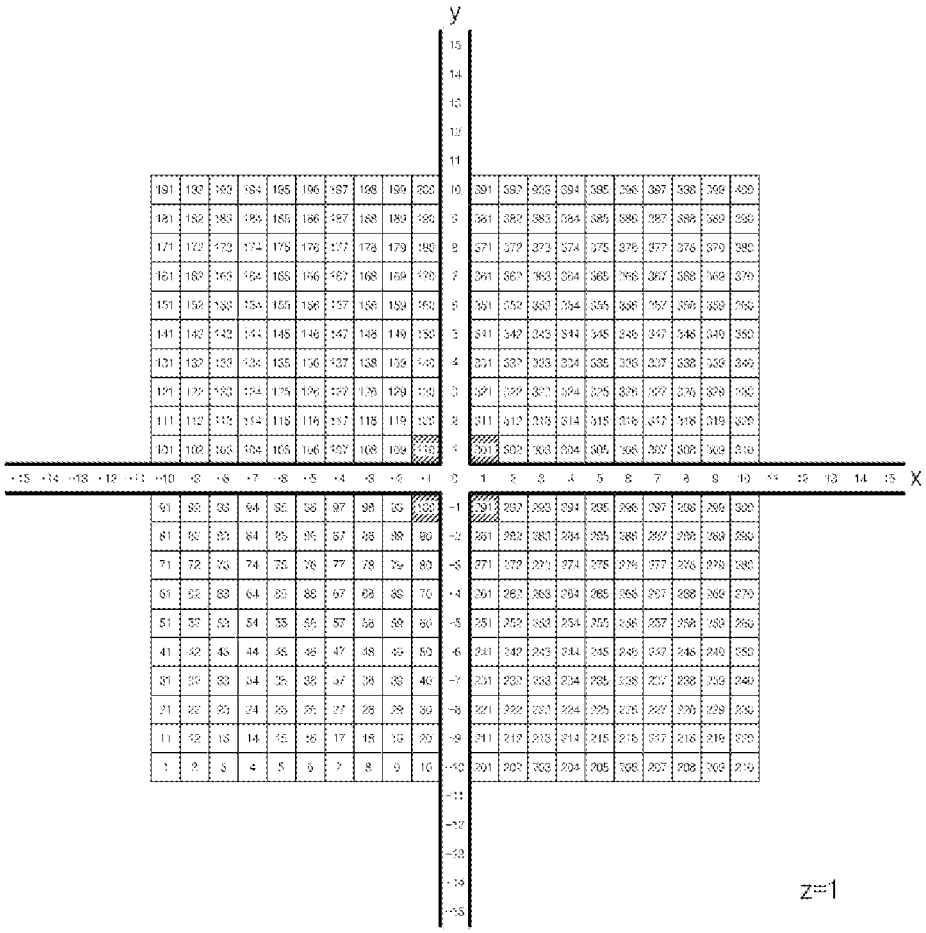
FIG. 12A shows lighting effects produced based on the control information, according to another embodiment of the present disclosure.
Figure 12B:
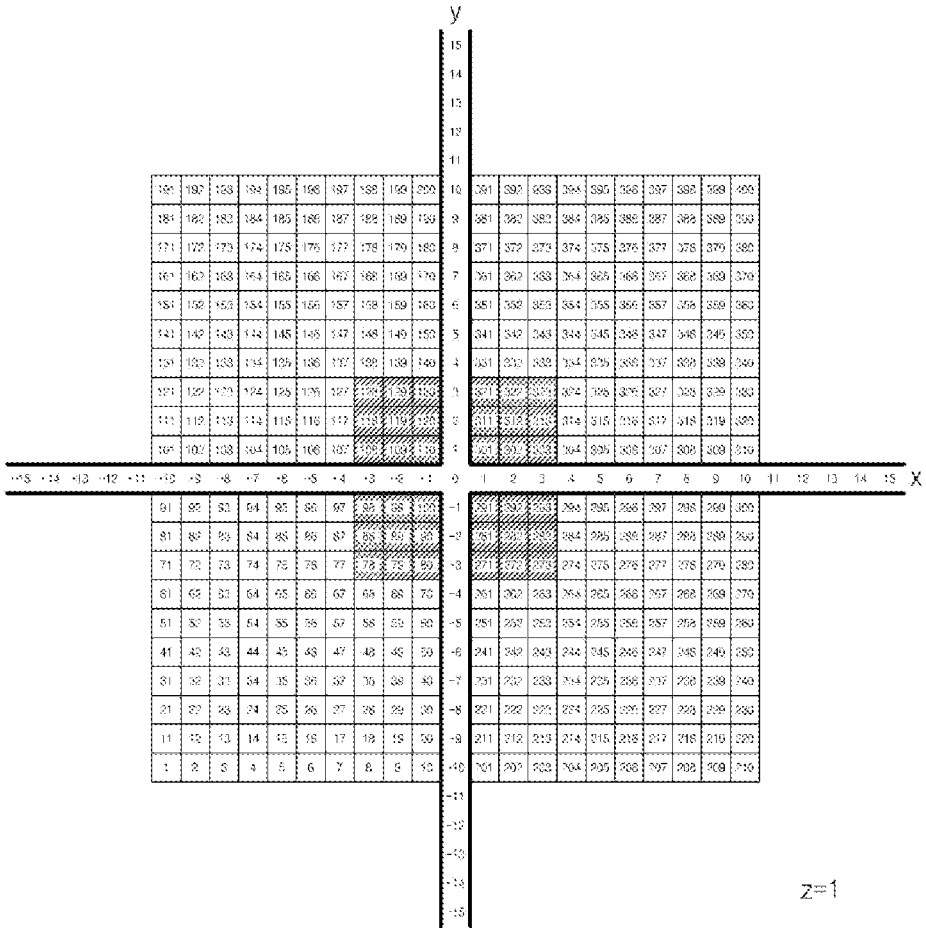
FIG. 12B shows lighting effects produced based on the control information, according to another embodiment of the present disclosure.
Figure 12C:
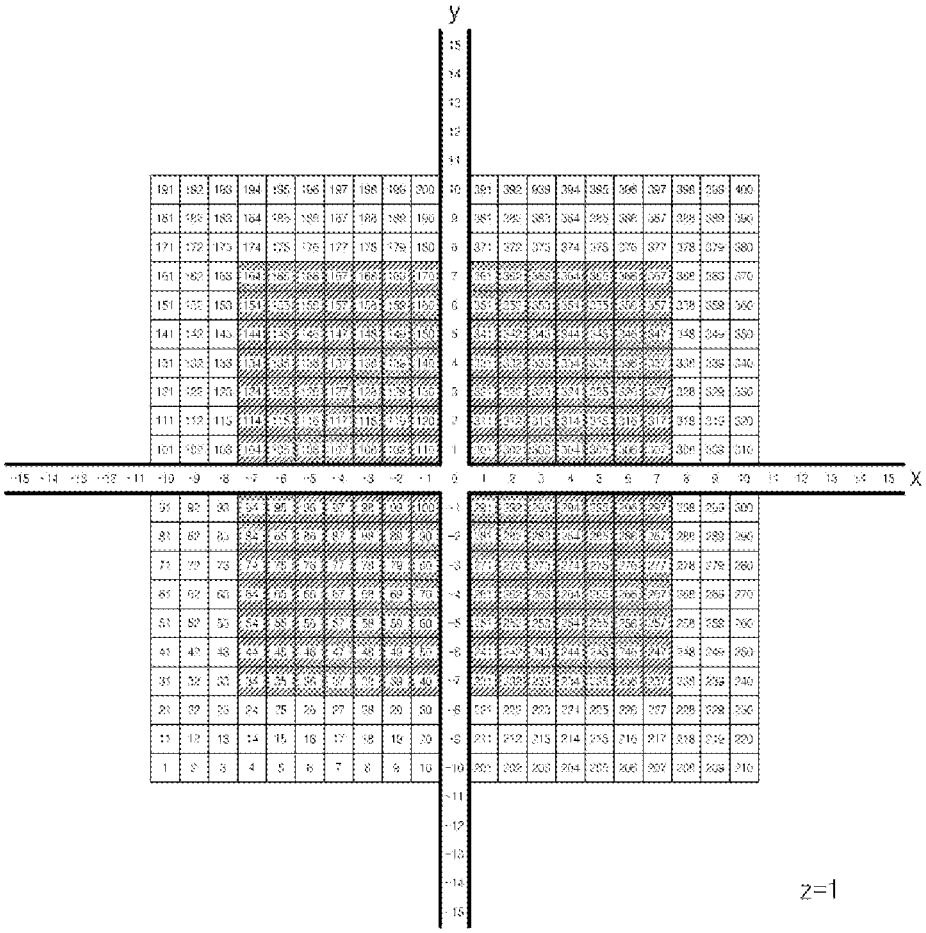
FIG. 12C shows lighting effects produced based on the control information, according to another embodiment of the present disclosure.
Figure 12D:
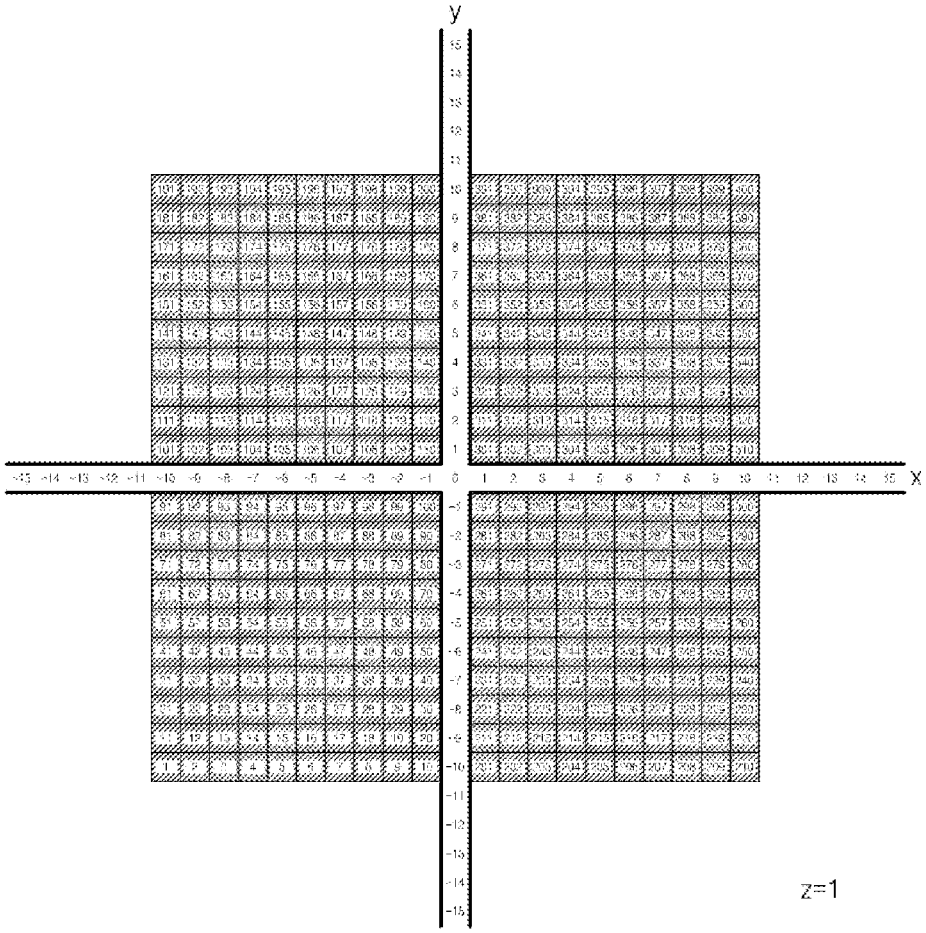
FIG. 12D shows lighting effects produced based on the control information, according to another embodiment of the present disclosure.

The lighting control method in the example shown in FIG. 11C is performed in the same manner as in FIG. 8. As shown in FIG. 11, lighting effects of a variety of shapes with the same function type can be produced by setting the region index information in different manners. Since the function type and the method of determining lighting modes of the lighting devices are the same as described above, repeated explanations will not be given.

FIG. 12 shows lighting effects produced based on the control information, according to another embodiment of the present disclosure.

Specifically, FIG. 12 shows examples in which region parameter information included in the function information is changed. That is to say, examples in which only the region parameter information is changed in the control information of FIG. 8, are shown in FIGS. 12A to 12D. FIG. 12A shows an example in which the region parameter information has a region parameter value d of being 2 (d=2) in the function information of FIG. 8, FIG. 12B shows an example in which the region parameter information has a region parameter value d of being 6 (d=6) in the function information of FIG. 8, FIG. 12C shows an example in which the region arameter information has a region parameter value d of being 6 (d=6) in the function information of FIG. 8, and FIG. 12D shows an example in which the region parameter information has a region parameter value d of being 6 (d=6) in the function information of FIG. 8.

As shown in FIG. 12, the lighting effects of a variety of shapes can be produced using the same function type by setting the region parameter information in different manners. In particular, the range of lighting shapes obtained from the function can be controlled by controlling the region parameter information. Since the function type and the method of determining lighting modes of the lighting devices are the same as described above, repeated explanations will not be given.

Figure 13:
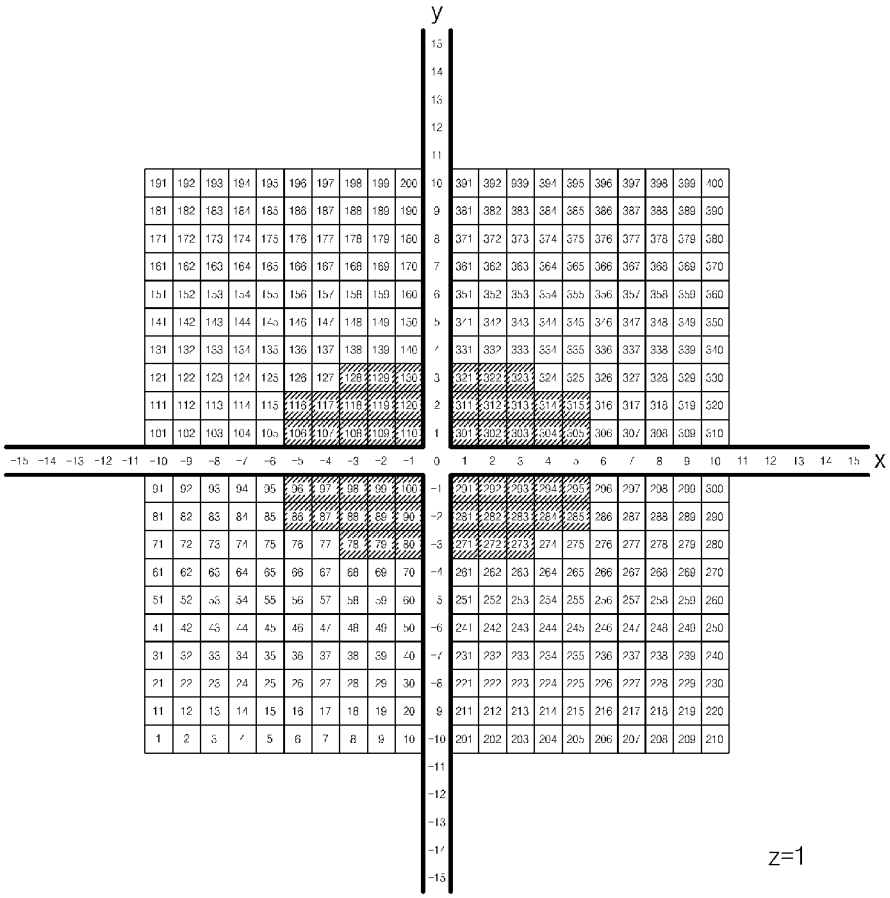
FIG. 13 shows a lighting effect produced based on the control information, according to another embodiment of the present disclosure.

FIG. 13 shows lighting effects produced based on the control information, according to another embodiment of the present disclosure.

The control information of FIG. 13(*a*) will be described as follows.

Code information: The code information indicates A1. This may correspond to a code of company A's artist 1.

Response information: The response information corresponds to (255, 0, 0, 0). In the example shown in FIG. 13, the response information indicates a color, and (255, 0, 0, 0) indicates a red color.

Function index information: The function index indicates a function numbered a pre-allocated value 2. In the example shown in FIG. 13, the function 2 is expressed as follows:

$$\frac{(x-a)^2}{m^2}+\frac{(y-b)^2}{n^2}=d. \qquad \text{Function 2}$$

Function name information: The function name information indicates that no text interpretation algorithm function will be used. Values of the function name information may include a null value and an arbitrary value.

Function parameter information: The function parameter information indicates that parameter values required for function interpretation are a=0, b=0, m=6, and n=4.

Region index information: When the function is in the range of smaller than or equal to d, the function is true. That is to say, when the operation result value of the left side of the function 2 is smaller than or equal to d, the function is true.

Region parameter information: The region parameter information has a region parameter value d of being 1.

Each lighting device applies its coordinate value to a corresponding function, and determines to respond when the operation result of the corresponding function is true. That is to say, the control information of FIG. 13 provides the following conditional expression by the function 2:

$$(x-0)^2/6^2+(y-0)^2/4^2\leq 1.$$

Referring to FIG. 13, the seat number 1 is mapped to a coordinate value (−10, −10, 1). When this coordinate value is applied to the function 2, the processing result is as follows:

$$(-10-0)^2/6^2+(-10-0)^2/4^2\approx 9.028.$$

When the left side of the expression is compared with the conditional expression of the function 2, 20≤10 is determined to be false, and thus the lighting device of the seat number 1 will not respond.

Referring to FIG. 13, the seat number 301 is mapped to a coordinate value (1, 1, 1). When this coordinate value is applied to the function 2, the processing result is as follows:

$$(1-0)^2/6^2+(1-0)^2/4^2\approx 0.09.$$

When the left side of the expression is compared with the conditional expression of the function 2, 0.09≤10 is determined to be true, and thus the lighting device of the seat number 301 will be lit in a red color.

In such a manner, all of the lighting devices having received the control information of FIG. 13 apply their coordinate values to process the function information and then determine whether to respond to the received control information or not, according to the processing result. The lighting devices having determined to respond in the same manner as in the aforementioned example may simultaneously respond, thereby producing the elliptical red lighting effect, as shown in FIG. 13(*b*).

Figure 14:
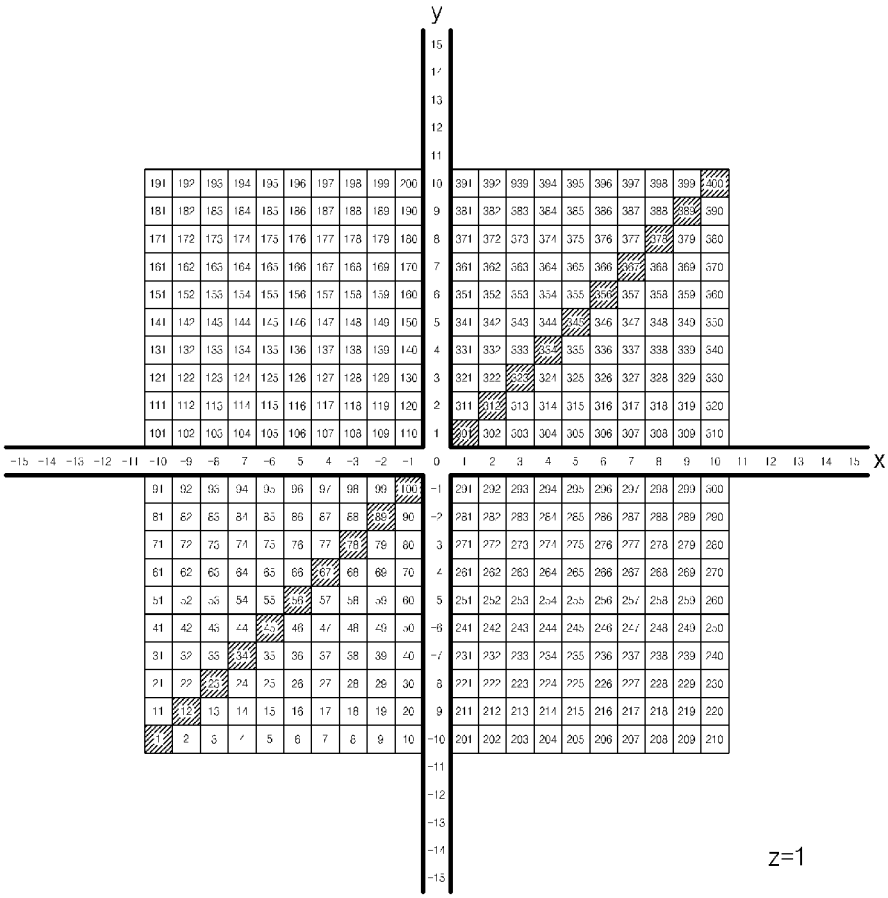
FIG. 14 shows a lighting effect produced based on the control information, according to another embodiment of the present disclosure.

FIG. 14 shows lighting effects produced based on the control information, according to another embodiment of the present disclosure.

The control information of FIG. 14(*a*) will be described as follows.

Code information: The code information indicates A1. This may correspond to a code of company A's artist 1.

Response information: The response information corresponds to (255, 0, 0, 0). In this example, the response information indicates a color, and (255, 0, 0, 0) indicates a red color.

Function index information: The function index indicates a function numbered a pre-allocated value 3. In the example shown in FIG. 14, the function 3 is expressed as follows:

$$(y-a)=m(x-b)+n \qquad \text{Function 3:}$$

Function name information: The function name information indicates that no text interpretation algorithm function will be used. Values of the function name information may include a null value and an arbitrary value.

Function parameter information: The function parameter information indicates that parameter values required for function interpretation are a=0, b=0, m=1, and n=0.

Region index information: The region index information indicates 1 (=). When the operation result values of the left side and the right side are equal, the function is determined to be true.

Region parameter information: The region parameter information has no region parameter value d. As an embodiment, the corresponding region parameter information may be transmitted as 0 or a null value.

Each lighting device applies its coordinate value to a corresponding function, and determines to respond when the operation result of the corresponding function is true. That is to say, the control information of FIG. 14 provides the following conditional expression by the function 3:

$$(y-0)=1(x-0)+0.$$

Referring to FIG. 14, the lighting device of the seat number 1 is mapped to a coordinate value (−10, −10, 1). When this coordinate value is applied to the function 3, the processing result is as follows:

$$(-10-0)=1(-10-0)+0.$$

When the left side and the right side of the expression are compared, −10=−10 is determined to be true, and thus the lighting device of the seat number 1 will be lit in a red color.

Referring to FIG. 14, the lighting device of the seat number 2 is mapped to a coordinate value (−9, −10, 1). When this coordinate value is applied to the function 3, the processing result is as follows:

$$(-10-0)=1(-9-0)+0.$$

When the left side and the right side of the expression are compared, −10=−9 is determined to be false, and thus the lighting device of the seat number 2 will not respond.

In such a manner, all of the lighting devices having received the control information of FIG. 14 apply their coordinate values to process the function information and then determine whether to respond to the received control information or not, according to the processing result. The lighting devices having determined to respond in the same manner as in the aforementioned example may simultaneously respond, thereby producing a diagonally straight red lighting effect with a predetermined slope, as shown in FIG. 14(*b*).

Figure 15:
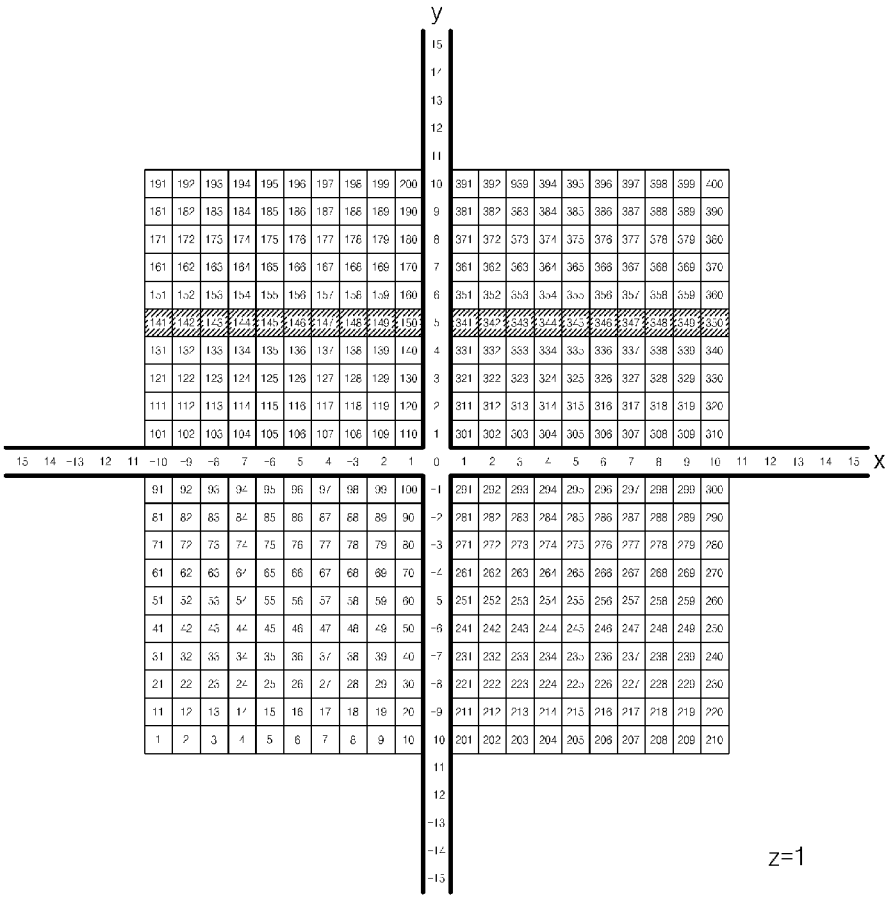
FIG. 15 shows a lighting effect produced based on the control information, according to another embodiment of the present disclosure.

FIG. 15 shows lighting effects produced based on the control information, according to another embodiment of the present disclosure.

The control information of FIG. 15(*a*) will be described as follows.

Code information: The code information indicates A1. This may correspond to a code of company A's artist 1.

Response information: The response information corresponds to (255, 0, 0, 0). In this example, the response information indicates a color, and (255, 0, 0, 0) indicates a red color.

Function index information: The function index indicates a function numbered a pre-allocated value 4. In the example shown in FIG. 15, the function 4 is expressed as follows:

$$y=a. \qquad \text{Function 4:}$$

Function name information: The function name information indicates that no text interpretation algorithm function will be used. Values of the function name information may include a null value and an arbitrary value.

Function parameter information: The function parameter information indicates that a parameter value required for function interpretation is a=5.

Region index information: The region index information indicates 1 (=). When the operation result values of the left side and the right side are equal, the function is determined to be true.

Region parameter information: The region parameter information has no region parameter value d. As an embodiment, the corresponding region parameter information may be transmitted as 0 or a null value.

Each lighting device applies its coordinate value to a corresponding function, and determines to respond when the operation result of the corresponding function is true. That is to say, the control information of FIG. 15 provides the following conditional expression by the function 4:

$$y=5.$$

Referring to FIG. 15, the lighting devices having a coordinate value 5 allocated thereto as a y-axis value determine that the function is true. Thus, the lighting devices having the y-axis value 5 will be lit in a red color.

In other words, all of the lighting devices having received the control information of FIG. 15 apply their coordinate values to process the function information and then determine whether to respond to the received control information or not, according to the processing result. The lighting devices having determined to respond in the same manner as in the aforementioned example may simultaneously respond, thereby producing a horizontally straight red lighting effect, as shown in FIG. 15(*b*).

Figure 16:
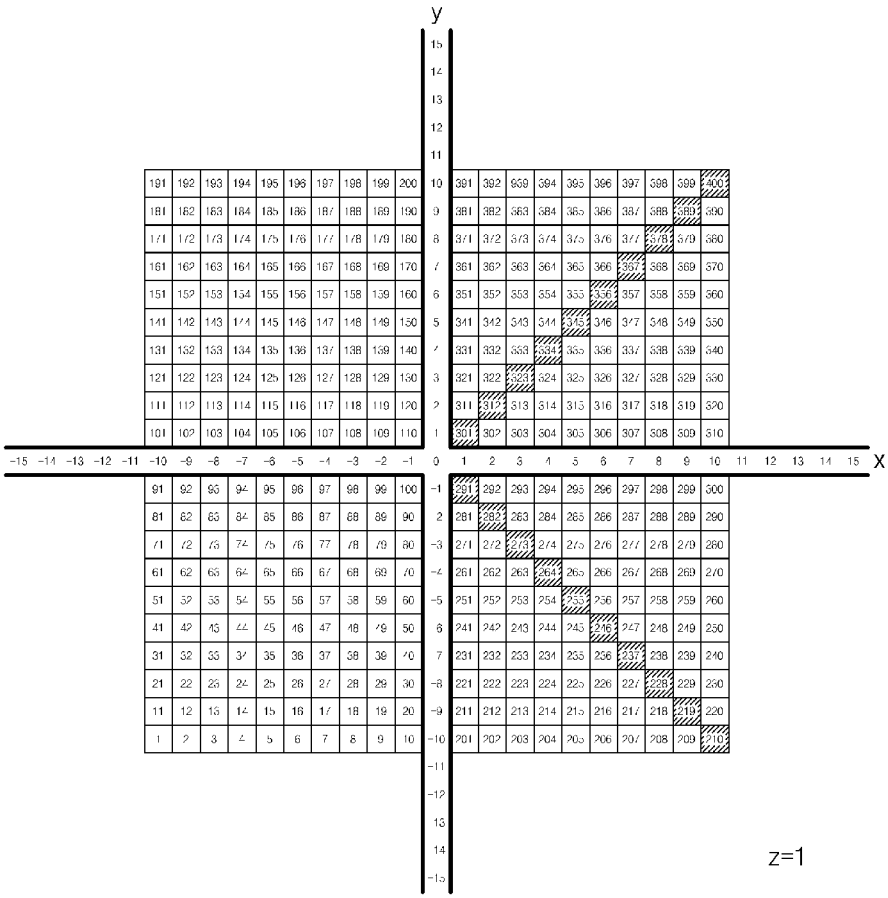
FIG. 16 shows a lighting effect produced based on the control information, according to another embodiment of the present disclosure.

FIG. 16 shows lighting effects produced based on the control information, according to another embodiment of the present disclosure.

The control information of FIG. 16(*a*) will be described as follows.

Code information: The code information indicates A1. This may correspond to a code of company A's artist 1.

Response information: The response information corresponds to (255, 0, 0, 0). In this example, the response information indicates a color, and (255, 0, 0, 0) indicates a red color.

Function index information: The function index indicates a function numbered 155. In the example shown in FIG. 16, the function index 255 indicates that a text interpretation algorithm function, rather than a preset function, will be used. In the example shown in FIG. 16, the text interpretation algorithm function is expressed as follows:

$$|y|=x.$$

Function parameter information: There is no function parameter information required for function interpretation in the example shown in FIG. 16. The function parameter information may indicate using a null value or a predetermined value that there is no function parameter value.

Region index information: The region index information indicates 1 (=). When the operation result values of the left side and the right side are equal, the function is determined to be true.

Region parameter information: The region parameter information has no region parameter value d. As an embodiment, the corresponding region parameter information may be transmitted as 0 or a null value. An arbitrary value of the region parameter information may indicate that there is no region parameter value.

Each lighting device applies its coordinate value to a corresponding function, and determines to respond when the operation result of the corresponding function is true. That is to say, the control information of FIG. 16 provides the following conditional expression by the text interpretation algorithm function:

$$|y|=x.$$

Based on the text interpretation algorithm function, all of the lighting devices having coordinate values, the absolute values of which are the same as x-values, may operate according to response information.

All of the lighting devices having received the control information of FIG. 16 apply their coordinate values to process the function information and then determine whether to respond to the received control information or not, according to the processing result. The lighting devices having determined to respond in the same manner as in the aforementioned example may simultaneously respond, thereby producing a diagonally bent straight red lighting effect, as shown in FIG. 16(*b*).

Figure 17:
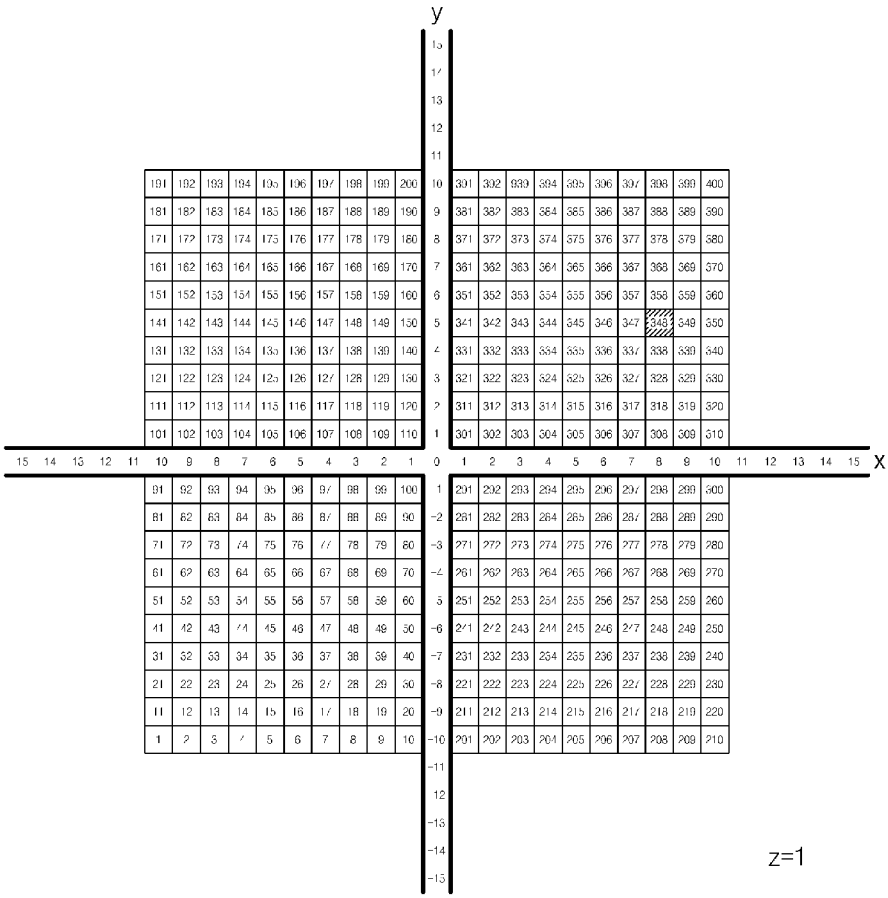
FIG. 17 shows a lighting effect produced based on the control information, according to another embodiment of the present disclosure.

FIG. 17 shows lighting effects produced based on the control information, according to another embodiment of the present disclosure.

The control information of FIG. 16(*a*) will be described as follows.

Code information: The code information indicates A1. This may correspond to a code of company A's artist 1.

Response information: The response information corresponds to (255, 0, 0, 0). In this example, the response information indicates a color, and (255, 0, 0, 0) indicates a red color.

Function index information: The function index indicates a function numbered a pre-allocated value 254. In the example shown in FIG. 17, the function 254 is expressed as follows:

Function 254: $(x,y,z)=(a,b,c).$

The above function can also be expressed as follows:

$$(x,y,z):\ x=a \text{ and } y=b \text{ and } z=c.$$

Function name information: The function name information indicates that no text interpretation algorithm function will be used. Values of the function name information may include a null value and an arbitrary value.

Function parameter information: The function parameter information indicates that parameter values required for function interpretation are a=8, b=5, and c=1.

Region index information: The region index information indicates 1 (=). When the operation result values of the left side and the right side are equal, the function is determined to be true.

Region parameter information: The region parameter information has no region parameter value d. As an embodiment, the corresponding region parameter information may be transmitted as 0 or a null value.

Each lighting device applies its coordinate value to a corresponding function, and determines to respond when the operation result of the corresponding function is true. That is to say, the control information of FIG. 17 provides the following conditional expression by the function 254:

$$(x,y,z)=(8,5,1).$$

Referring to FIG. 17, only a lighting device having a corresponding value (8, 5, 1) determines that the function is true. Therefore, as shown in FIG. 17(*b*), only the lighting device of a seat number 348 determines to operate based on the control information.

In such a manner, all of the lighting devices having received the control information of FIG. 17(*a*) apply their coordinate values to process the function information and then determine whether to respond to the received control information or not, according to the processing result. The lighting devices having determined to respond in the same manner as in the aforementioned example may simultaneously respond, thereby producing a red lighting effect displayed at a specific point, as shown in FIG. 17(*b*).

Figure 18:
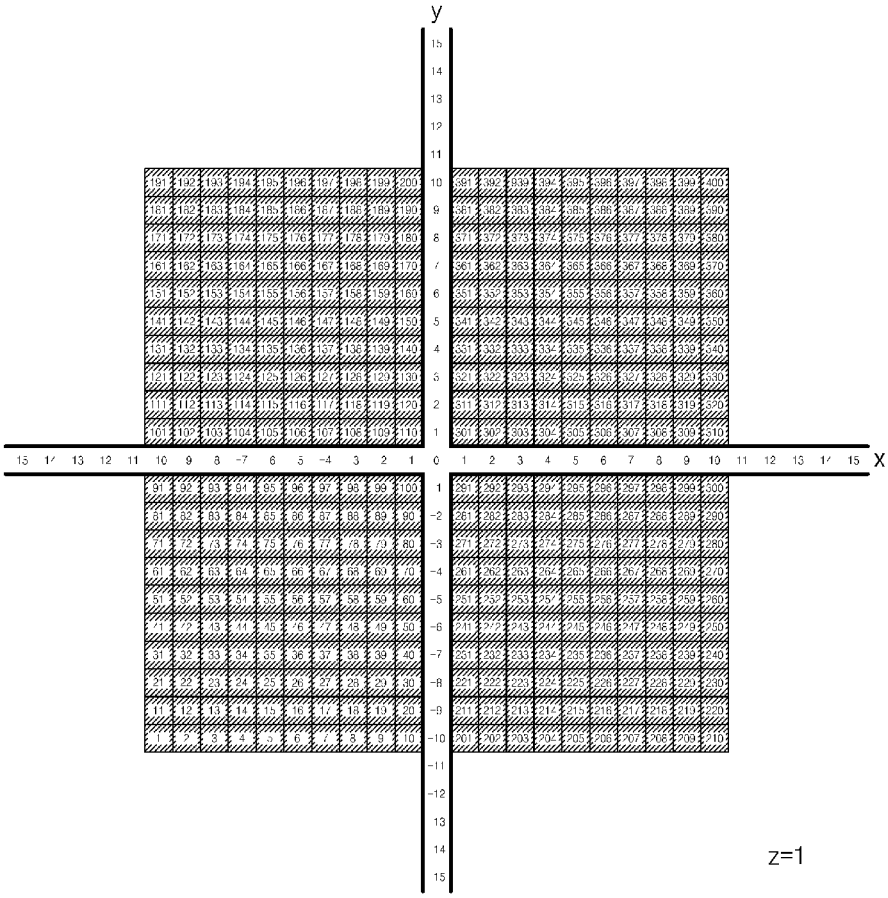
FIG. 18 shows a lighting effect produced based on the control information, according to another embodiment of the present disclosure.

FIG. 18 shows lighting effects produced based on the control information, according to another embodiment of the present disclosure.

The control information of FIG. 18(*a*) will be described as follows.

Code information: The code information indicates A1. This may correspond to a code of company A's artist 1.

Response information: The response information corresponds to (255, 0, 0, 0). In this example, the response information indicates a color, and (255, 0, 0, 0) indicates a red color.

Function index information: The function index indicates a function numbered a pre-allocated value 101. In the example shown in FIG. 18, the function 101 is expressed as follows:

Function 101: $z=a.$

Function name information: The function name information indicates that no text interpretation algorithm function will be used. Values of the function name information may include a null value and an arbitrary value.

Function parameter information: The function parameter information indicates that a parameter value required for function interpretation is a=1.

Region index information: The region index information indicates 1 (=). When the operation result values of the left side and the right side are equal, the function is determined to be true.

Region parameter information: The region parameter information has no region parameter value d. As an embodiment, the corresponding region parameter information may be transmitted as 0 or a null value.

Each lighting device applies its coordinate value to a corresponding function, and determines to respond when the operation result of the corresponding function is true. That is to say, the control information of FIG. 18 provides the following conditional expression by the function 101:

$z=1.$

Referring to FIG. 18, only a lighting device having a corresponding coordinate value z of being 1 determines that the function is true. Therefore, as shown in FIG. 18(*b*), all lighting devices located on a plane where z=1 will respond.

In such a manner, all of the lighting devices having received the control information of FIG. 18 apply their coordinate values to process the function information and then determine whether to respond to the received control information or not, according to the processing result. The lighting devices having determined to respond in the same manner as in the aforementioned example may simultaneously respond, thereby producing a red lighting effect displayed by all lighting devices located on a specific plane, as shown in FIG. 18(*b*).

As an embodiment, a performance venue may be divided into a plurality of two-dimensional planes and different z-values may be allocated thereto. For example, coordinates of first floor seats may be allocated to x and y planes, where z=1, and coordinates of second floor seats may be allocated to x and y planes, where z=2. In such a manner as in FIG. 18, controlling a lighting effect can be achieved on the basis of a specific plane.

Figure 19:
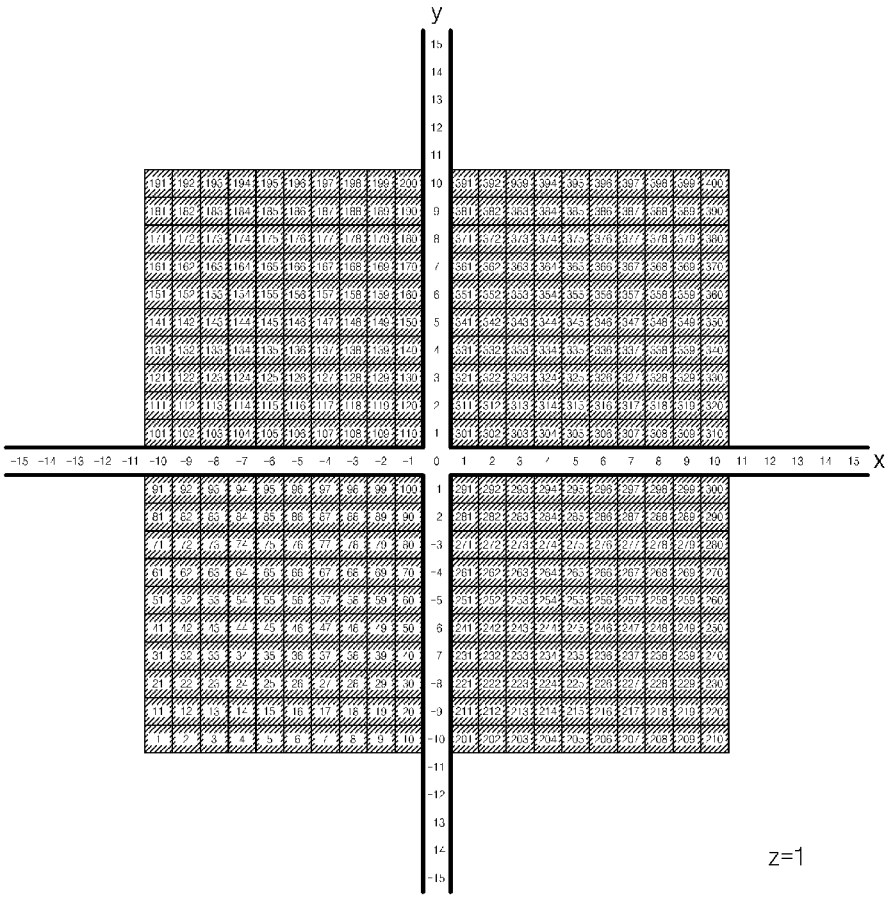
FIG. 19 shows a lighting effect produced based on the control information, according to another embodiment of the present disclosure.

FIG. 19 shows lighting effects produced based on the control information, according to another embodiment of the present disclosure.

The control information of FIG. 19(*a*) will be described as follows.

Code information: The code information indicates A1. This may correspond to a code of company A's artist 1.

Response information: The response information corresponds to (255, 0, 0, 0). In this example, the response information indicates a color, and (255, 0, 0, 0) indicates a red color.

Function index information: The function index indicates a function numbered a pre-allocated value 0. In the example shown in FIG. 18, the function index 0 indicates unconditional response, regardless of function.

Function name information: The function name information indicates that no text interpretation algorithm function will be used. Values of the function name information may include a null value and an arbitrary value.

Function parameter information: The function parameter information indicates that a parameter value required for function interpretation is a=1.

Region index information: The region index information indicates 1 (=). When the operation result values of the left side and the right side are equal, the function is determined to be true.

Function parameter information: There is no function parameter information.

Region index information: There is no region index information.

Region parameter information: There is no region parameter information.

The example shown in FIG. 19 is used in collectively controlling all of the lighting devices located in the performance venue, regardless of function conditions. In FIG. 19(*a*), a specific function index value 0 indicates an unconditional response, regardless of the function. However, a specific value in arbitrary information included in the function information may indicate the entire responses of the lighting devices.

In such a manner, all of the lighting devices having received the control information of FIG. 19 may be lit in a red color, regardless of the function.

As an embodiment, the performance venue may be divided into a plurality of two-dimensional planes, and different z-values may be allocated thereto. For example, coordinates of first floor seats may be allocated to x and y planes, where z=1, and coordinates second floor seats may be allocated to x and y planes, where z=2. In such a manner as in FIG. 19, controlling a lighting effect can be achieved on the basis of a specific plane.

As an embodiment, there may be a lighting device which has failed in coordinate mapping or has never been subjected to coordinate mapping. In such a case, since no coordinate value is allocated to the lighting device, the lighting device is not in a position to respond according to the function. However, the lighting device may operate regardless of the coordinate value, by an control signal for entire control, like in the example shown in FIG. 19, thereby maintaining at least unity in performance production.

For example, a red color based lighting effect may be produced at a timing t1 of the performance production, and a blue color based lighting effect may be produced at a timing t2. A device without coordinate mapping may be lit in a red color even after the timing t2, impairing the continuity in the performance production. In this case, according to the present disclosure, at the timing t2, lighting colors of all devices may be changed into blue by the entire/overall control signal. Next, during function-based controlling, even the lighting device without coordinate mapping is being lit in the blue color, thereby minimizing discontinuity in presenting a color lighting effect.

Figure 20:
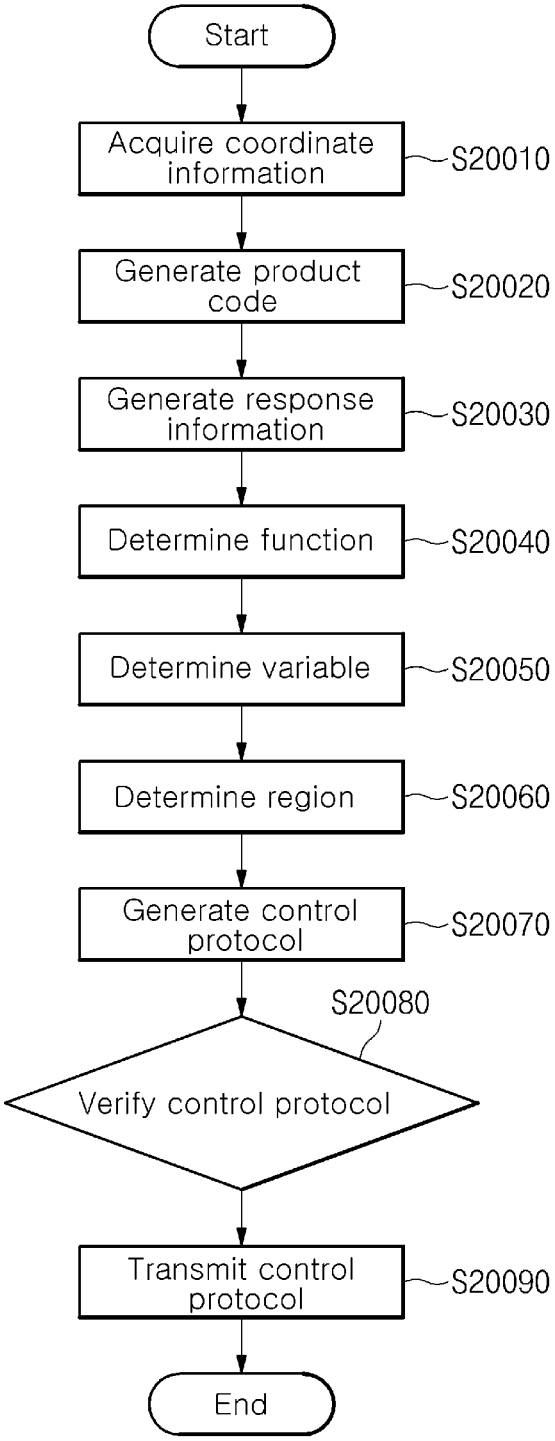
FIG. 20 shows a lighting control method for controlling a lighting control device according to an embodiment of the present disclosure.

FIG. 20 shows a lighting control method of a lighting control device according to an embodiment of the present disclosure.

The lighting control device may acquire coordinate information (S20010). The coordinate information indicates a coordinate system or coordinate values, to which the wireless lighting devices are mapped.

The lighting control device generates a product code, that is, code information (S20020). The lighting control device generates response information (S20030). The lighting control device determines a function (S20040). The lighting device determines parameter/parameter value related to the function (S20050). The lighting function is used to determine a region related to the function (S20060).

The lighting control device generates a control protocol for controlling a plurality of lighting devices (S200700). The control protocol corresponds to lighting control information. The lighting control device verifies the control protocol (S20080). Then, the lighting control device transmits the control protocol (S20090).

Figure 21:
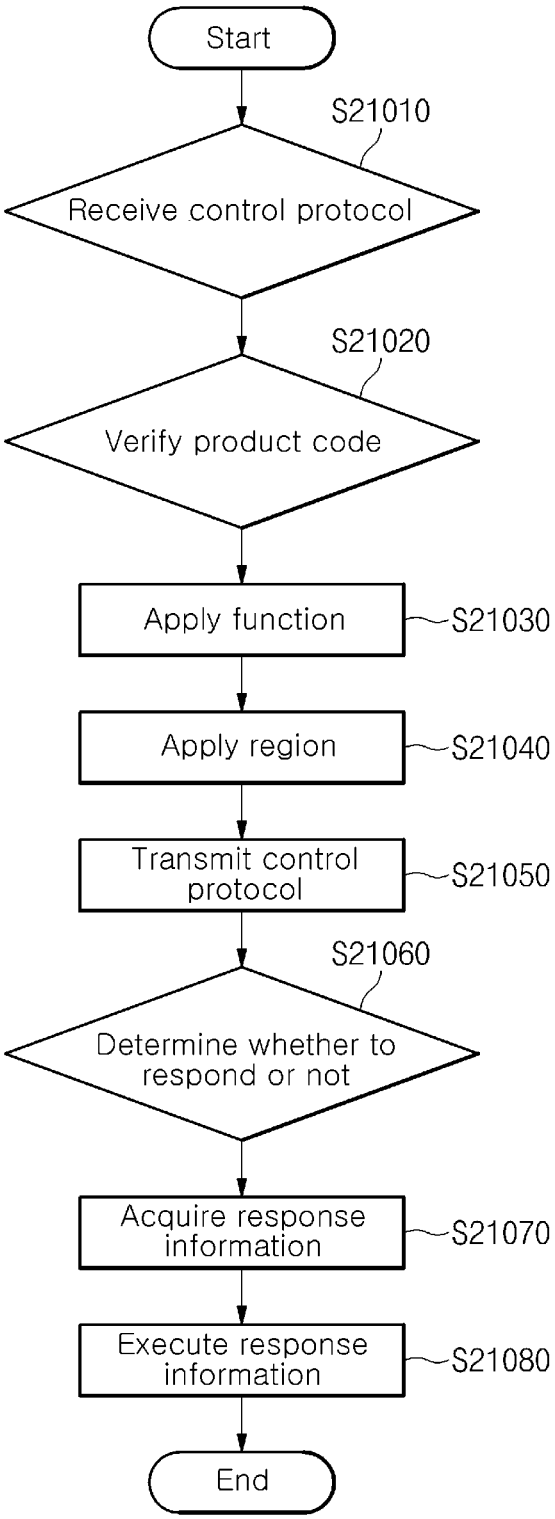
FIG. 21 shows a lighting control method for controlling a wireless lighting device according to an embodiment of the present disclosure.

FIG. 21 shows a lighting control method of a wireless lighting device according to an embodiment of the present disclosure.

The wireless lighting device receives a control protocol, that is, lighting control information (S21010). The wireless lighting device verifies a product code of the received control protocol (S21020).

If the product code is verified, the wireless lighting device applies a function contained in the control protocol (S21030). The wireless lighting device applies a parameter contained in the control protocol (S21040). The wireless lighting device applies a region contained in the control protocol (S21050).

The wireless lighting device interprets the function to determine whether to respond or not (S21060), and if the wireless lighting device responds, the wireless lighting device acquires response information (S21070), and then execute the response information (S21080).

Figure 22:
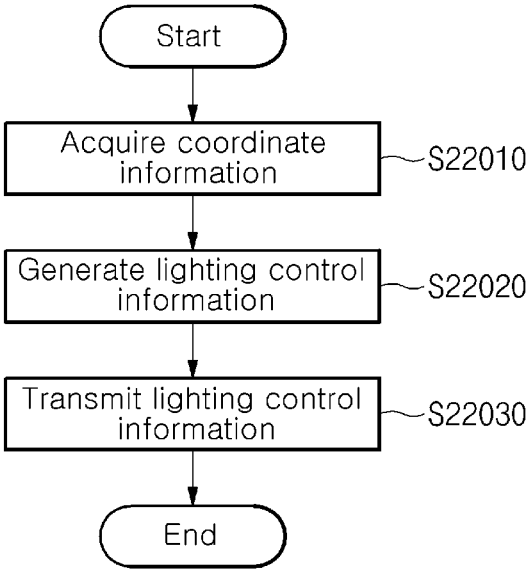
FIG. 22 is a flow chart showing a method for controlling a plurality of wireless lighting devices of the lighting control device according to an embodiment of the present disclosure.

FIG. 22 is a flow chart showing a method for controlling a plurality of wireless lighting devices of the lighting control device according to an embodiment of the present disclosure.

The control device may acquire coordinate information (S22010).

Here, the control device may acquire the coordinate information about coordinate values of a coordinate system mapped to a plurality of wireless lighting devices. The control device may acquire the coordinate information by performing a mapping operation, or may acquire the coordinate information including previously-mapped coordinates. The coordinate information may include at least one of coordinate values for the entire coordinate system, seat numbers mapped to the coordinate values or mapping relationships, and information about mapped devices.

The control device may generate lighting control information (S22020).

The control device may generate lighting control information for producing a lighting shape of the coordinate system by indicating a response of at least one of a plurality of wireless lighting devices. The lighting control information may include response information and function information. The response information may indicate a lighting response of the wireless lighting device. The function information may indicate a response or non-response of the at least one wireless lighting device coordinate value, on the basis of the coordinate value.

The control device may transmit the lighting control information (S22030).

The control device may transmit the lighting control information by packetizing the lighting control information and frequency-upconverting the same. The control device may transmit the lighting control information using a broadcasting scheme. However, the control device may broadcast the lighting control information by transmitting the corresponding lighting control information to a peripheral broadcasting device in a wired/wireless manner. In the embodiment of the present, the lighting control information may not be transmitted to a specific lighting device but may be transmitted to all lighting devices positioned within a signal transmission range, which is referred to as the broadcasting transmission mode.

As described above, the function information may include at least one of indicating at least one function representing a lighting shape, and function-related information representing additional information for function interpretation.

As described above, the function may be interpreted as a response or non-response of a wireless lighting device having a coordinate value by applications of the coordinate value and function-related information.

As described above, the function-related information may include at least one of function parameter information, region index information and region parameter information. The function parameter information may indicate a function parameter value. Alternatively, the function parameter information may indicate a function parameter value. The region index information may indicate a function interpretation mode. That is to say, the region index information may provide a standard or range for interpreting the function as being true by indicating the relationship between the left side and the right side of the function. The region parameter information may indicate scaling of the function.

As described above, when the function information includes or corresponds to a specific value, the lighting control information may indicate all responses of the plurality of lighting devices, regardless of coordinate values. That is to say, the control device may indicate all responses of the plurality of lighting devices located within a communication range (the entire turn-on or turn-off operation of a specific color) by setting a value of data included in the lighting control information to the specific value.

As described above, the function indicator information may include at least one of function index information representing a function index of at least one of a plurality of pre-stored functions, and text function information providing a description of at least one function.

As described above, each of the plurality of lighting devices may be mapped to a coordinate of a coordinate system on the basis of its seat number in a performance venue. However, according to embodiments, the lighting devices may be mapped to a producing coordinate system based on location information, such as GPS coordinate values. In addition, for the sake of performance production, the plurality of lighting devices may be mapped to a single coordinate value, or a single lighting device may be mapped to a plurality of coordinate values.

As described above, the response control information may further include code information. The code information may be used to identify product codes of identifies product codes of the wireless lighting devices. The code information may include at least one of company code information and artist code information.

As described above, the response information may additionally selectively indicate acoustic response information or haptic response information of the wireless lighting device.

The above descriptions given with reference to FIGS. 1 to 21 may apply to the control method of FIG. 22. For example, the same descriptions given with regard to FIGS. 4 and 5 may apply to the coordinate information, and the same descriptions given with regard to FIGS. 7 to 19 may apply to the lighting control information.

The function information may also be referred to as response condition information in that it indicates a response or non-response of each wireless lighting device. That is to say, the response condition information allows the wireless lighting device to determine whether to respond or not by applications of its own coordinate value after receiving the response condition information. Accordingly, in order to produce a lighting shape, the control device may transmit one and the same function information/response condition information to all receiving lighting devices of the lighting system. Therefore, the identification information used to identify some lighting devices for performance production can be skipped, thereby lowering the quantity of data transmitted.

In the present disclosure, in order to control a wireless lighting device of a specific location, a specific coordinate value is mapped to the wireless lighting device. In addition, the whole wireless lighting devices can be controlled by a control algorithm protocol using a reduced quantity of packets. The control information may not include functions, device identification information or coordinate values. The wireless lighting device processes the control information by analyzing/interpreting the function, index, parameter, parameter value or argument using a specific function and function-related information, and responds according to the processing result. Since the specific coordinate value, function and variables are used, a desired lighting shape can be controlled in real time with a small quantity of packets.

Figure 23:
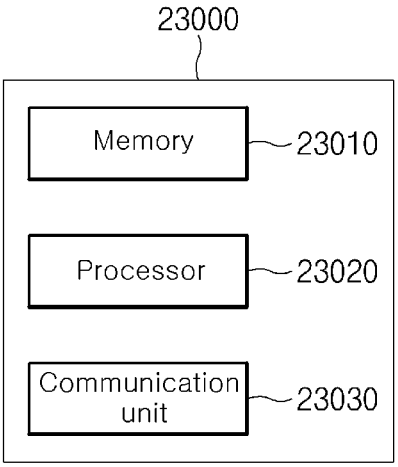
FIG. 23 shows a lighting control device for controlling a plurality of lighting devices according to an embodiment of the present disclosure.

FIG. 23 shows a lighting control device for controlling a plurality of lighting devices according to an embodiment of the present disclosure.

A memory 23010 is connected to a processor 23020 and stores a variety of data/information for driving the processor 23020. The memory 23010 may be incorporated into the processor 23020 or may be installed outside the processor 23020 to be connected to the processor by known means. The memory 23010 collectively refers to a volatile memory and a nonvolatile memory. In the present disclosure, the memory 23010 may store a program, an application, or a program code to execute the above-described lighting control method.

The processor 23020 may be connected to the memory 23010 and may execute the method for controlling a plurality of lighting devices according to the present disclosure. At least one of a module, data, a program or software for implementing the operation of a system 23000 according to various embodiments of the present disclosure may be stored in the memory 23010 and may be executed by the processor 23020. The processor 23020 may execute the method of the present disclosure by driving an application/software for performing the method of the present disclosure. The processor 23020 may be provided as one or a plurality of processing chips.

A communication unit 23030 may perform wired or wireless communication with an external device of the system. The communication unit 23030 may include one or a plurality of communication chip sets. The communication unit 23030 may include a communication module and may perform communication based on a variety of communication protocols including, for example, cable, 3G, 4G (LTE), 5G, WIFI, Bluetooth, NFC, or Zigbee. The communication unit 23030 may further include a plurality of subordinate communication devices operating according to respective communication protocols.

As an embodiment, the control device 23000 is a computing system, which can be included in any electronic device. The control device 23000 or the control device processor 23020 may perform the method for controlling the plurality of wireless lighting devices, which has already been described above with reference to FIGS. 1 to 22.

For example, the control device for controlling the plurality of wireless lighting devices includes a memory storing data, a communication unit performing communication with an external device, and a processor connected to the memory and the communication unit and operating the controlling device. The control device/processor may acquire coordinate information having coordinate values of a coordinate system mapped to the plurality of wireless lighting devices, may generate lighting control information indicating a response or non-response of at least one of the plurality of wireless lighting devices to produce a lighting shape of the coordinate system, and may transmit the lighting control information. Here, the lighting control information may include response information and function information, the response information may indicate a lighting response of the wireless lighting device, and the function information may indicate the response or non-response of the at least one of the plurality of wireless lighting devices based on the coordinate value.

Figure 24:
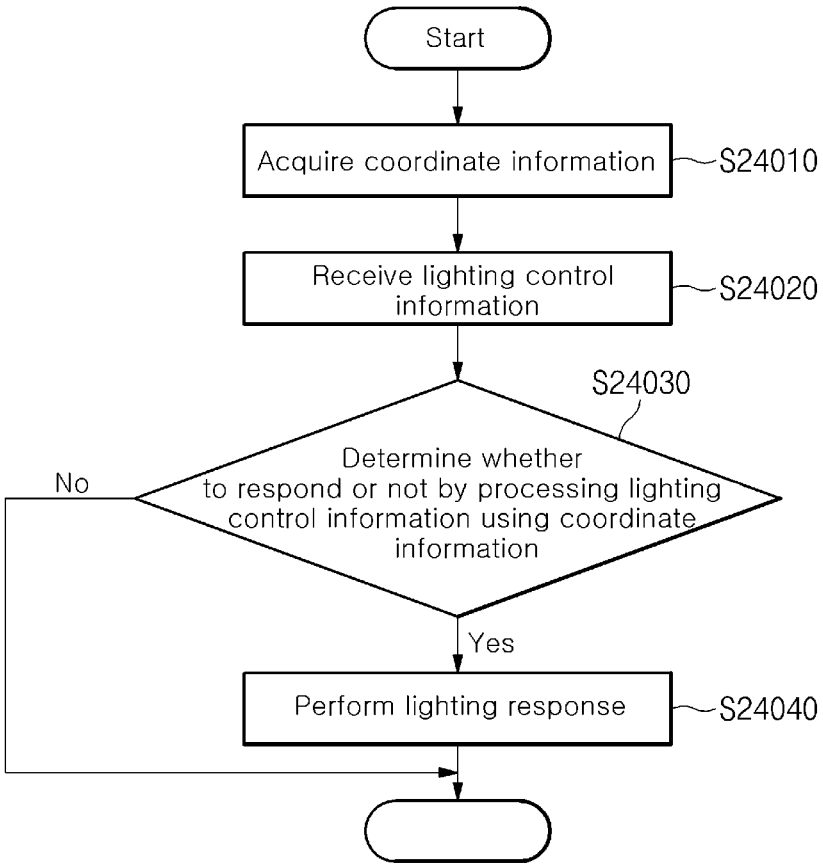
FIG. 24 is a flow chart showing a controlling of wireless lighting device.

FIG. 24 is a flow chart showing a method for operating a wireless lighting device for producing a lighting effect according to an embodiment of the present disclosure.

The wireless lighting device may acquire coordinate information (S24010).

The wireless lighting device may acquire the coordinate information having mapped coordinate values of a coordinate system. The wireless lighting device may acquire the coordinate information from the control device. The coordinate information may be preset to the wireless lighting device. The coordinate information may include at least one of coordinate values for the entire coordinate system, seat numbers mapped to the coordinate values or mapping relationships, and information about mapped devices. As an embodiment, the wireless lighting device may acquire a coordinate value of the coordinate system for the seat number or location thereof.

The wireless lighting device may receive lighting control information (S24020).

The wireless lighting device may receive lighting control information for producing a lighting shape of the coordinate system. The lighting control information may include response information and function information. The response information may indicate a lighting response of the wireless lighting device. The function information may indicate a response or non-response of the wireless lighting device based on the coordinate value.

The wireless lighting device may determine whether to respond or not by processing the lighting control information using the coordinate information (S24030).

As described above, the wireless lighting device may determine whether to respond or not by the application of the coordinate information to the function information included in the lighting control information. The processing of the lighting control information may mean parsing the lighting control information and interpreting the function information by the application of the coordinate information.

If it is determined to respond, the wireless lighting device may perform the lighting response (S24040). If it is determined not to respond, the wireless lighting device may be maintained at a lighting state. The lighting response may encompass any arbitrary response, except for being maintained at its former state.

As described above, the function information may include at least one of function indicator information indicating at least one function representing the lighting shape, and function-related information representing additional information for function interpretation.

As described above, the function may be interpreted as the response or non-response of the wireless lighting device having the coordinate value by applications of the coordinate value and the function-related information.

As described above, the function-related information may include at least one of function parameter information, region index information and region parameter information. The function parameter information may indicate a parameter value of the function. In addition, the function parameter information may indicate a factor/parameter value. The region index information may indicate an interpretation mode of the function. That is to say, the region index information may provide a standard or range for interpreting the function as being true by indicating the relationship between the left side and the right side of the function. The region parameter information indicates scaling of the function.

As described above, when the function information includes or corresponds to a specific value, the lighting control information may indicate a response of the lighting device, regardless of its coordinate value. That is to say, the control device may indicate all responses of the plurality of lighting devices located within a communication range (the entire turn-on or turn-off operation of a specific color) by setting a value of data included in the lighting control information to the specific value. When the function information of the lighting control information includes or corresponds to a specific value, it can be determined whether to respond or not in S22030 without using the coordinate information.

As described above, the function indicator information may include at least one of function index information representing a function index of at least one of a plurality of pre-stored functions, and text function information providing a description of at least one function.

As described above, the wireless lighting device may be mapped to a coordinate of a coordinate system on the basis of its seat number in a performance venue. However, according to embodiments, the wireless lighting device may be mapped to a producing coordinate system based on location information, such as GPS coordinate values. In addition, for the sake of performance production, a plurality of wireless lighting devices may be mapped to a single coordinate value, or a single wireless lighting device may be mapped to a plurality of coordinate values.

As described above, the response control information may further include code information. The code information may be used to identify product codes of identifies product codes of the wireless lighting devices. The code information may include at least one of company code information and artist code information.

As described above, the response information may additionally selectively indicate acoustic response information or haptic response information of the wireless lighting device.

The above descriptions given with reference to FIGS. 1 to 21 may apply to the operating method of FIG. 24. For example, the same descriptions given with regard to FIGS. 4 and 5 may apply to the coordinate information, and the same descriptions given with regard to FIGS. 7 to 19 may apply to the lighting control information.

The function information may also be referred to as response condition information in that it indicates a response or non-response of the wireless lighting device. That is to say, the response condition information allows the wireless lighting device to determine whether to respond or not by the application of its own coordinate value in processing the received lighting control information. Accordingly, in order to produce a lighting shape, the control device may transmit one and the same function information/response condition information to all receiving wireless lighting devices of the lighting system. Therefore, identification information used to identify some wireless lighting devices for performance production can be skipped, thereby lowering the quantity of data transmitted.

In the present disclosure, in order to control a wireless lighting device of a specific location, a specific coordinate value is mapped to each of the wireless lighting devices. In addition, the whole wireless lighting devices can be controlled by a control algorithm protocol using a reduced quantity of packets. The control information may not include functions, device identification information or coordinate values. The wireless lighting device processes the control information by interpreting the function, index, parameter, parameter value or argument using a specific function and function-related information, and responds according to the processing result. Since the specific coordinate value, function and variables are used, a desired lighting shape can be controlled in real time with a small quantity of packets.

Figure 25:
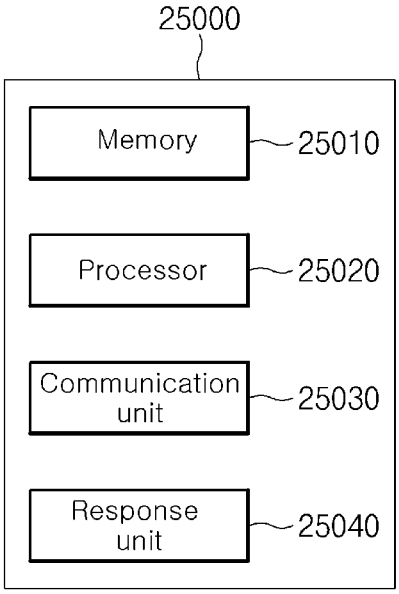
FIG. 25 shows a wireless lighting device according to an embodiment of the present disclosure.

FIG. 25 shows a wireless lighting device according to an embodiment of the present disclosure.

A memory 25010 is connected to a processor 25020 and stores a variety of data/information for driving the processor 25020. The memory 25010 may be incorporated into the processor 25020 or may be installed outside the processor 25020 to be connected to the processor by known means. The memory 25010 collectively refers to a volatile memory and a nonvolatile memory. In the present disclosure, the memory 25010 may store a program, an application, or a program code to execute the above-described lighting control method. A response unit 25040 may provide or control a visual/acoustic/haptic feedback.

The processor 25020 may be connected to the memory 25010 and may execute the method for controlling a plurality of wireless lighting devices according to the present disclosure. At least one of a module, data, a program or software for implementing the operation of a system 25000 according to various embodiments of the present disclosure may be stored in the memory 23010 and may be executed by the processor 23020. The processor 25020 may execute the method of the present disclosure by driving an application/software for performing the method of the present disclosure. The processor 25020 may be provided as one or a plurality of processing chips.

A communication unit 23030 may perform wired or wireless communication with an external device of the system. The communication unit 23030 may include one or a plurality of communication chip sets. The communication unit 23030 may include a communication module and may perform communication based on a variety of communication protocols including, for example, cable, 3G, 4G (LTE), 5G, WIFI, Bluetooth, NFC, or Zigbee. The communication unit 23030 may further include a plurality of subordinate communication devices operating according to respective communication protocols.

The response unit 25040 may provide or control at least one of a visual feedback, an acoustic feedback and a haptic feedback. As an embodiment, the response unit 25040 may provide a lighting effect based on the processing result of the lighting control information. The response unit 25040 may include or may be connected to a lighting device, such as an LED or an LCD. The response unit 25040 may correspond to the lighting device. In particular, the response unit 25040 may also be referred to a lighting response unit.

As an embodiment, the response unit 25040 may reside outside the wireless lighting device 25000, rather than being provided inside the wireless lighting device 25000. The wireless lighting device may transmit a lighting response command indicating a determined lighting response.

As an embodiment, the wireless lighting device 25000 is a computing system, which can be included in any electronic device. The wireless lighting device 25000 or the wireless lighting device processor 25020 may perform the method for controlling the plurality of wireless lighting devices, which has already been described above with reference to FIGS. 1 to 22.

For example, the wireless lighting device may acquire coordinate information about mapped coordinate values of a coordinate system, may receive lighting control information for producing a lighting shape of the coordinate system, may process the lighting control information to determine a lighting response, and may perform a lighting response based on the processing result. Here, the lighting control information may include response information and function information, the response information may indicate a lighting response of the wireless lighting device, and the function information may indicate the response or non-response of the wireless lighting device based on the coordinate value.

The above-described embodiments are results in which the elements and characteristics of the present invention are combined in a specific form. Each of the element or characteristics has to be considered as being optional unless otherwise explicitly described. Each of the elements or characteristics may be implemented in such a way as not to be combined with other elements or characteristics. Furthermore, some of the elements and/or the characteristics may be combined to form an embodiment of the present invention. Order of the operations described in the embodiments of the present invention may be changed. Some of the elements or characteristics of one embodiment may be included in the other embodiment or may be replaced with elements or characteristics corresponding to the other embodiment. It is evident that in the claims, embodiments may be constructed by combining claims not having an explicit citation relation or the claims not having an explicit citation relation may be included in a new claim according to amendments after an application.

The embodiments of the present disclosure can be implemented by a variety of means, for example, hardware, firmware, software or a combination thereof. In the case of hardware implementation, an example embodiment of the present disclosure may be implemented by application specific integrated circuits (ASICs), field programmable gate arrays (FPGAs), digital signal processors (DSPs), digital signal processing devices (DSPs), programmable logic devices (PLDs), field programmable gate arrays (FPGAs), processors, controllers, microcontrollers, microprocessors, or the like.

In the case of firmware or software implementation, an example embodiment of the present disclosure may be implemented in a format of a module, procedure, function or the like for executing the functions or operations having been described above. Software codes may be stored in a memory to be driven by a processor. The memory may reside inside or outside the processor to exchange data with the processor using various means known in the art.

It will be apparent to those skilled in the art that various changes in form and details may be made without departing from the spirit and the essential characteristics of the disclosure set forth herein. Accordingly, the above detailed description is not intended to be construed as limiting the disclosure in all aspects and to be considered by way of example. The scope of the disclosure should be determined by reasonable interpretation of the accompanying claims, and all equivalent modifications made without departing from the disclosure should be included in the scope of the disclosure.

MODE OF DISCLOSURE

Various embodiments have been described in the best mode for carrying out the invention.

INDUSTRIAL APPLICABILITY

The present disclosure is available in a series of performance producing fields.

It will be apparent to those skilled in the art that various modifications and alterations can be made in the present disclosure without departing from the spirit and scope of the present disclosure. This present disclosure is therefore intended to cover all such modifications and alterations of this disclosure provided they come within the scope of the appended claims and their equivalents.

What is claimed is:

1. A method of performing lighting response, comprising:

acquiring coordinate information having the wireless lighting device mapped to a coordinate value of a coordinate system, a plurality of wireless lighting devices being mapped to the coordinate system;

receiving lighting control information indicating a response of at least one of the plurality of wireless lighting devices to produce a lighting shape of the coordinate system, wherein the lighting control information includes response information and function information, the response information indicates a lighting response of the wireless lighting device in case of responding, and the function information indicates the lighting shape and whether or not to respond; and performing lighting response based on the response information in case of responding, and whether or not to respond is determined by applying the coordinate value to the function information; and wherein the function information includes function indicator information which indicates at least one function representing basic lighting shape of the coordinate system and shape variation information which controls variation of the basic lighting shape by at least one parameter or index relating to the at least one function.

2. The method of claim 1, wherein the shape variation information includes at least one of function parameter information, region index information and region parameter information, the function parameter information indicates a parameter value of the function, the region index information indicates an interpretation mode of the function, and the region parameter information indicates scaling of the function.

3. The method of claim 1, wherein when the function information includes a specific value, the lighting control information indicates entire responses of the plurality of wireless lighting devices, regardless of the coordinate values.

4. The method of claim 1, wherein the function indicator information includes at least one of function index information representing an index of at least one function of a plurality of pre-stored functions or text function information providing a description of the at least one function.

5. The method of claim 1, wherein the plurality of wireless lighting devices is mapped to coordinate values of the coordinate system based on a seat number of a venue, respectively.

6. The method of claim 1, wherein the lighting control information further includes at least one of code information or ID information, the code information identifies at least one of a company or an artist, and the ID information identifies device ID of the wireless lighting devices.

7. The method of claim 1, wherein the response information additionally indicates at least one of acoustic response information and haptic response information of the wireless lighting devices selectively and the wireless lighting device further performs at least one of acoustic response or haptic response in case of responding.

8. A wireless lighting device, comprising:

a memory storing data;

a communication unit performing communication with an external device;

a response unit generating lighting response; and a processor connected to the memory, the communication unit, and the response unit, the processor operating the wireless lighting devices;

to acquire coordinate information having the wireless lighting device mapped to a coordinate value of a coordinate system, a plurality of wireless lighting devices being mapped to the coordinate system;

to receive lighting control information indicating a response of at least one of the plurality of wireless lighting devices to produce a lighting shape of the coordinate system, wherein the lighting control information includes response information and function information, the response information indicates a lighting response of the wireless lighting device in case of responding, and the function information indicates the lighting shape and whether or not to respond; and to perform lighting response based on the response information in case of responding, wherein whether or not to respond is determined by applying the coordinate value to the function information;

wherein the function information includes function indicator information which indicates at least one function representing basic lighting shape of the coordinate system and shape variation information which controls variation of the basic lighting shape by at least one parameter or index relating to the at least one function.

9. The wireless lighting device of claim 8, wherein the shape variation information includes at least one of function parameter information, region index information and region parameter information, the function parameter information indicates a parameter value of the function, the region index information indicates an interpretation mode of the function, and the region parameter information indicates scaling of the function.

10. The wireless lighting device of claim 8, wherein when the function information includes a specific value, the lighting control information indicates entire responses of the plurality of wireless lighting devices, regardless of the coordinate values.

11. The wireless lighting device of claim 8, wherein the function indicator information includes at least one of function index information representing an index of at least one function of a plurality of pre-stored functions or text function information providing a description of the at least one function.

12. The wireless lighting device of claim 8, wherein the plurality of wireless lighting devices is mapped to coordinate values of the coordinate system based on a seat number of a venue, respectively.

13. The wireless lighting device of claim 8, wherein the lighting control information further includes at least one of code information or ID information, the code information identifies at least one of a company or an artist, and the ID information identifies device ID of the wireless lighting devices.

14. The wireless lighting device of claim 8, wherein the response information additionally indicates at least one of acoustic response information and haptic response information of the wireless lighting devices selectively and the wireless lighting device further performs at least one of acoustic response or haptic response in case of responding.

* * * * *